United States Patent [19]

Allen

[11] 4,253,351

[45] Mar. 3, 1981

[54] CORK EXTRACTOR

[75] Inventor: Herbert Allen, Houston, Tex.

[73] Assignee: Hallen Company, Houston, Tex.

[21] Appl. No.: 56,281

[22] Filed: Jul. 9, 1979

[51] Int. Cl.[3] ..... B67B 7/00

[52] U.S. Cl. ..... 81/3.38 A

[58] Field of Search ..... 81/3.31, 3.33, 3.37, 81/3.38 R, 3.38 A, 3.48

[56] References Cited

U.S. PATENT DOCUMENTS

| | | | |
|---|---|---|---|
| 532,575 | 1/1895 | Morgan | 81/3.31 |
| 562,645 | 6/1896 | McMaster | 81/3.33 |
| 593,698 | 11/1897 | Stoll | 81/3.37 |
| 620,949 | 3/1899 | Morgan | 81/3.33 |
| 644,088 | 2/1900 | Morgan | 81/3.33 |
| 676,205 | 6/1901 | Rogginger | 81/3.33 |
| 678,773 | 7/1901 | Coomber | 81/3.31 |
| 776,152 | 11/1904 | Strohacker et al. | 81/3.33 |
| 845,608 | 2/1907 | Bitner | 81/3.33 |

FOREIGN PATENT DOCUMENTS

| | | | |
|---|---|---|---|
| 2340898 | 9/1977 | France | 81/3.48 |

*Primary Examiner*—James G. Smith

*Attorney, Agent, or Firm*—Browning, Bushman & Zamecki

[57] ABSTRACT

Apparatus for extracting a cork from a bottle comprising a corkscrew rotatably mounted on a carrier, the carrier in turn being mounted for longitudinal reciprocation on a frame. The apparatus further includes a control nut having a screw passage positioned to receive the corkscrew and configured to mate with the configuration of the corkscrew whereby, upon longitudinal movement of the corkscrew in the screw passage, rotational movement will be imparted to the corkscrew. A latch, engageable and releasable independently of the force of gravity is provided for releasably latching the control nut to the frame to restrain relative longitudinal movement therebetween. Relative rotation between the control nut and the frame is also prevented. A bottle-engaging assembly is connected to the frame for positioning a bottle with respect to the frame in longitudinal alignment with the screw passage. The bottle-engaging assembly is associated with the latch and, when a bottle is engaged therein, is operative cooperatively with the engaged bottle to release the latch. The apparatus further comprises guide means laterally spaced from the corkscrew and cooperative between the frame and the carrier for guiding the latter in a longitudinal path. Means are also provided for restricting rotation of the corkscrew as it is raised from the bottle with the cork.

31 Claims, 26 Drawing Figures

FIG. 3
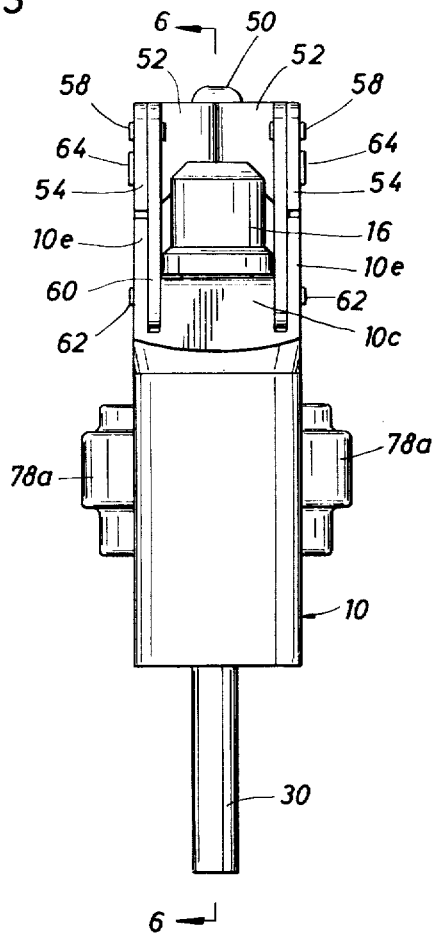
FIG. 4
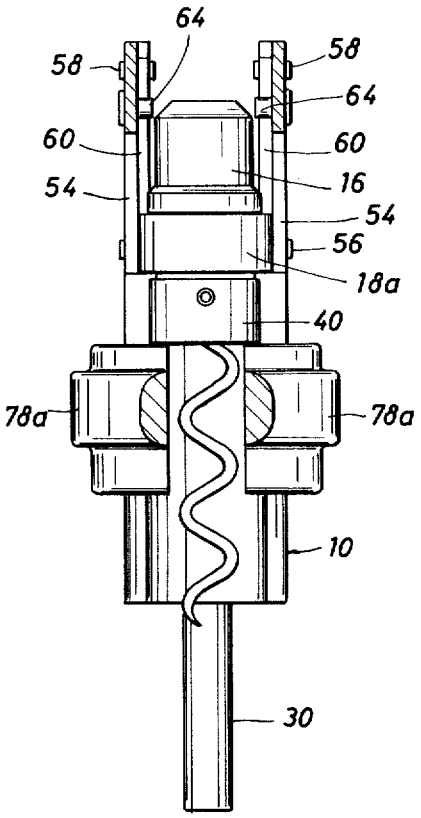
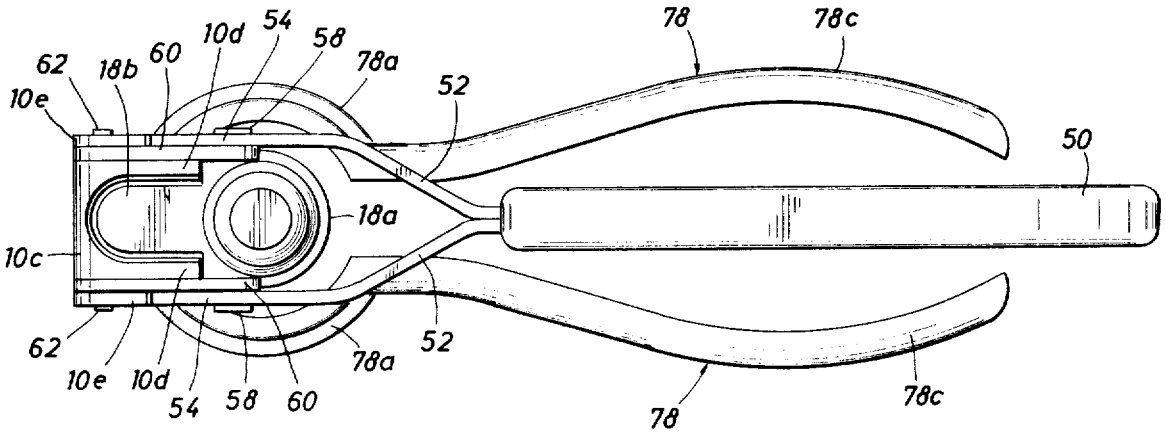
FIG. 5

FIG. 12
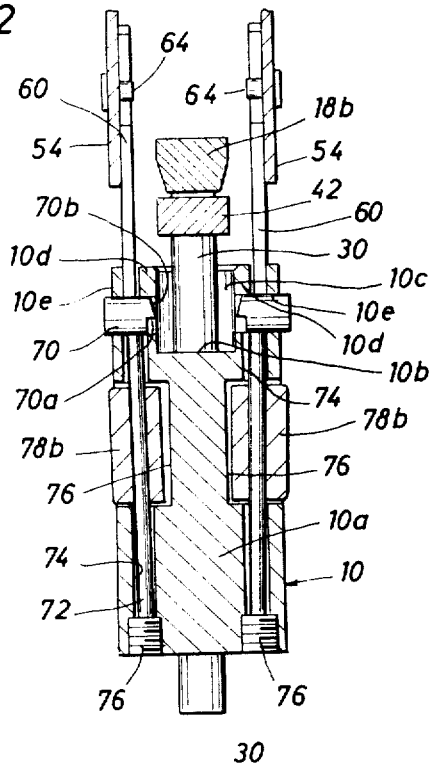
FIG. 13
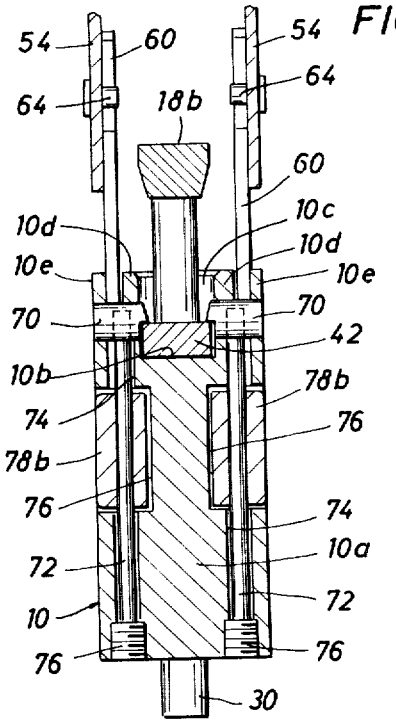
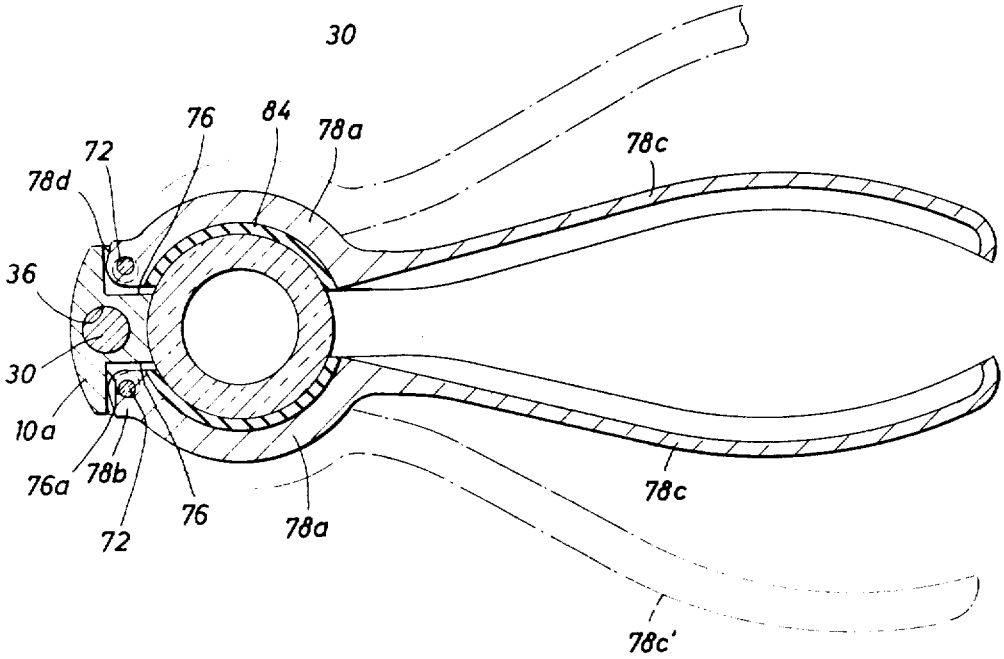
FIG. 14
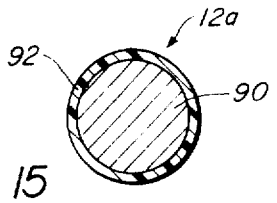
FIG. 15

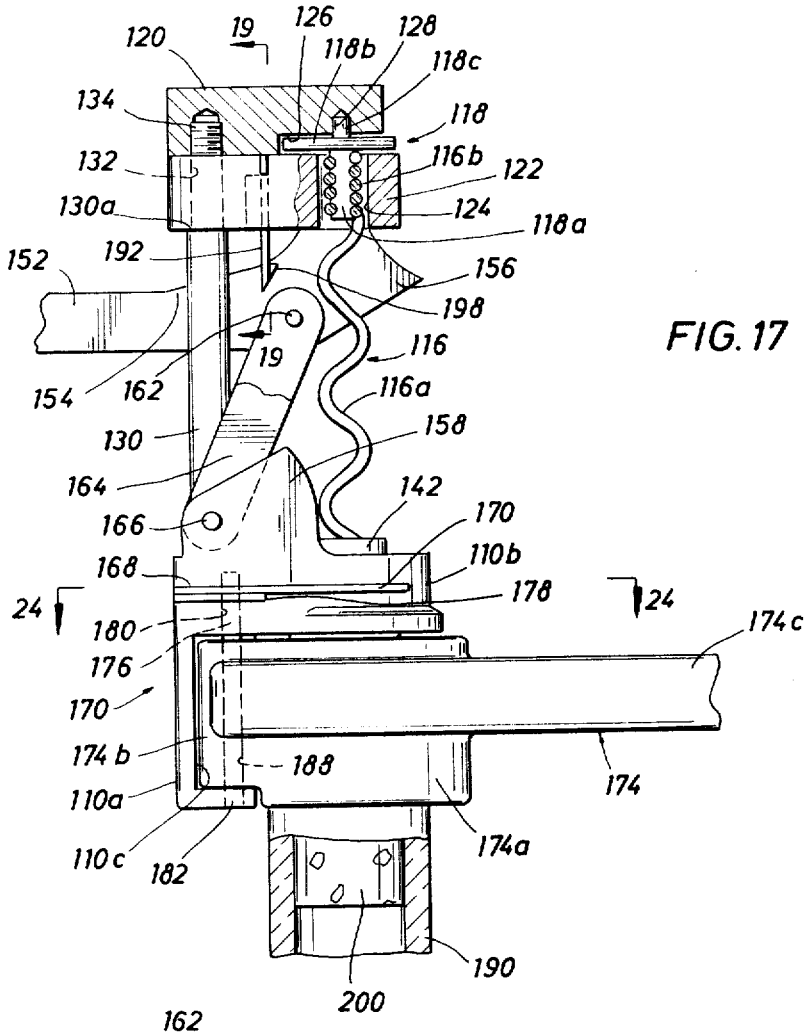
FIG. 17
FIG. 18
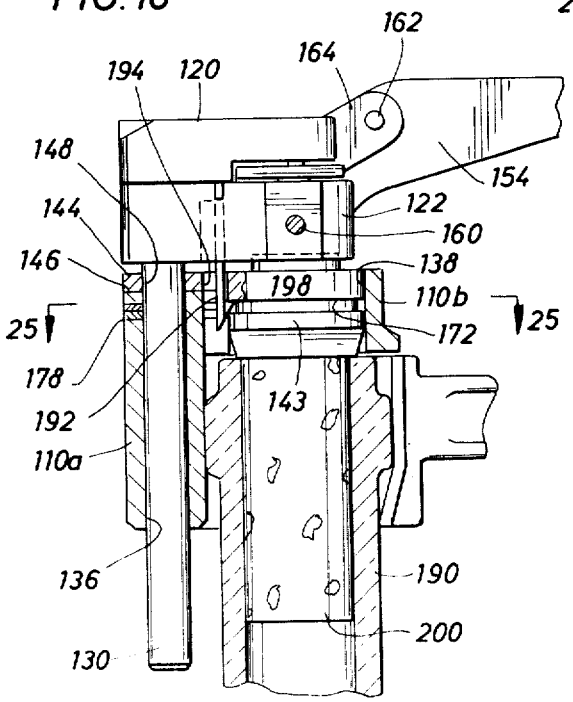
FIG. 19
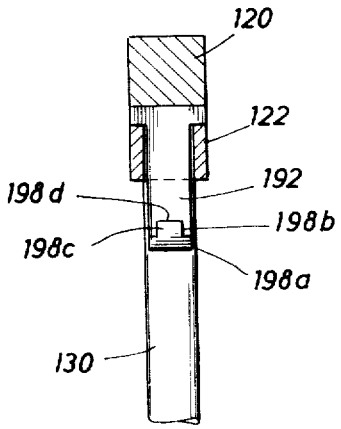

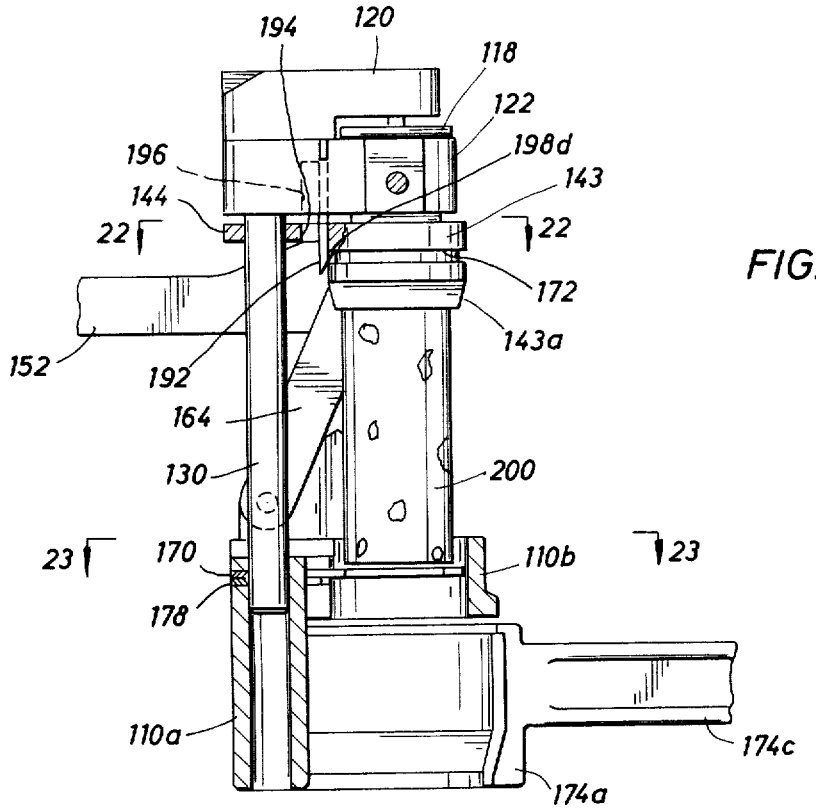
FIG. 20
FIG. 21
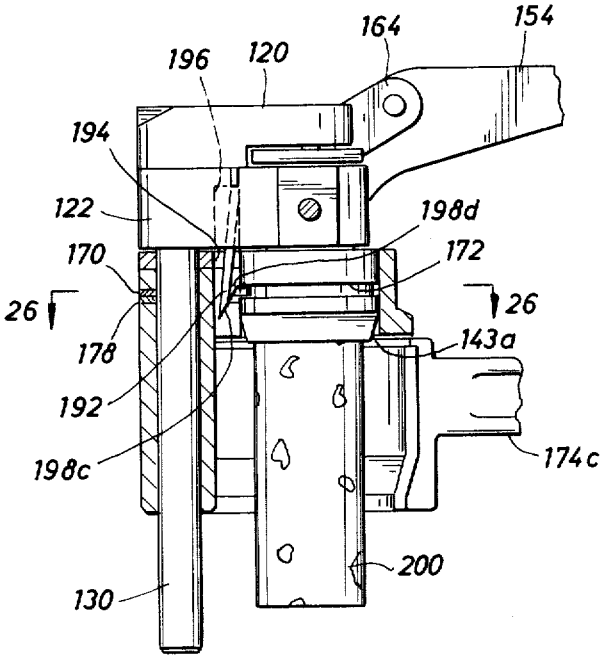
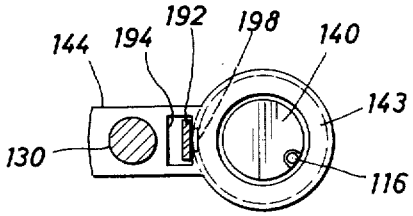
FIG. 22

FIG. 23
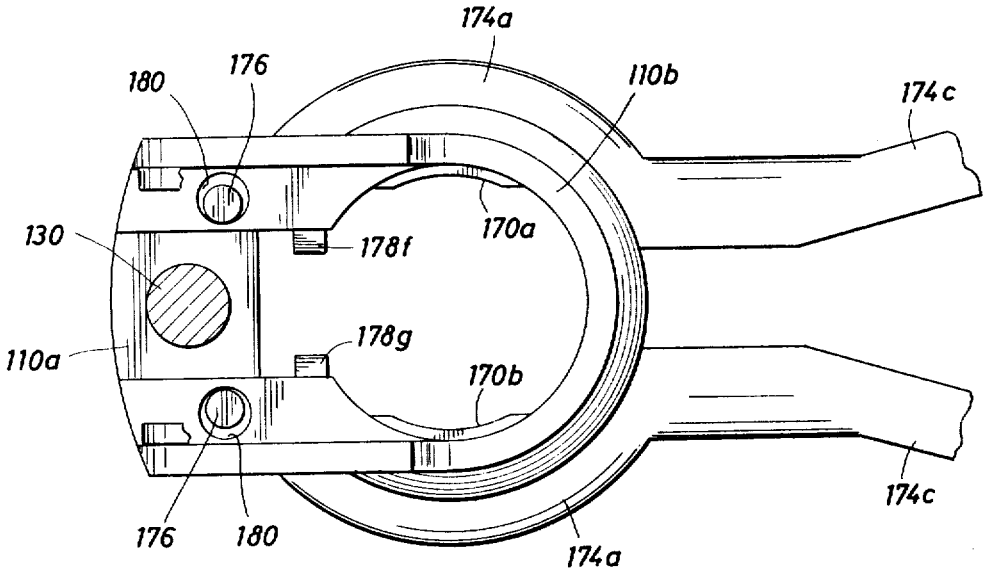
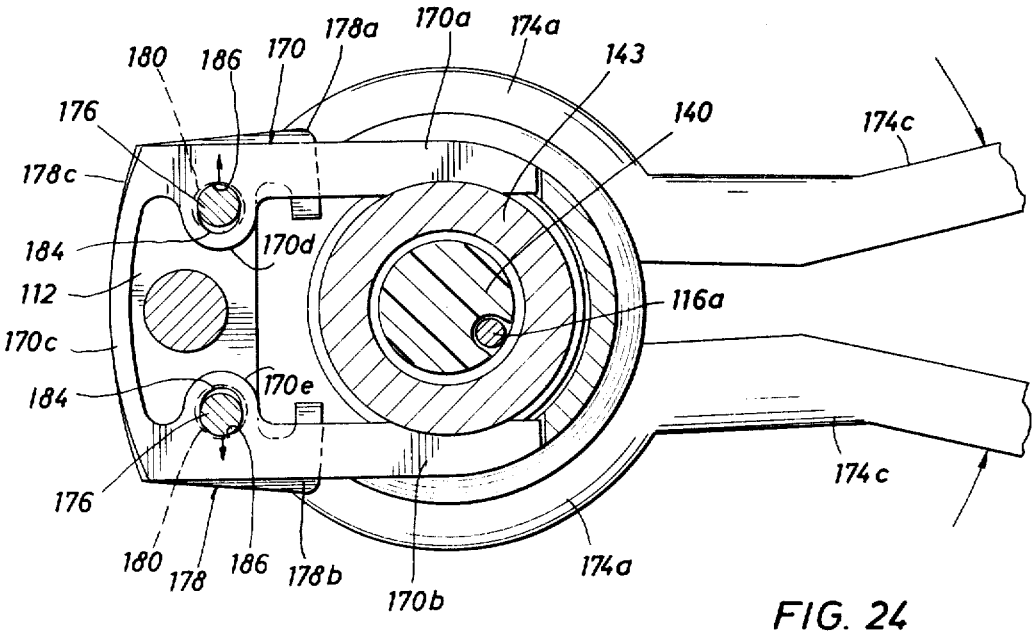
FIG. 24

FIG. 25
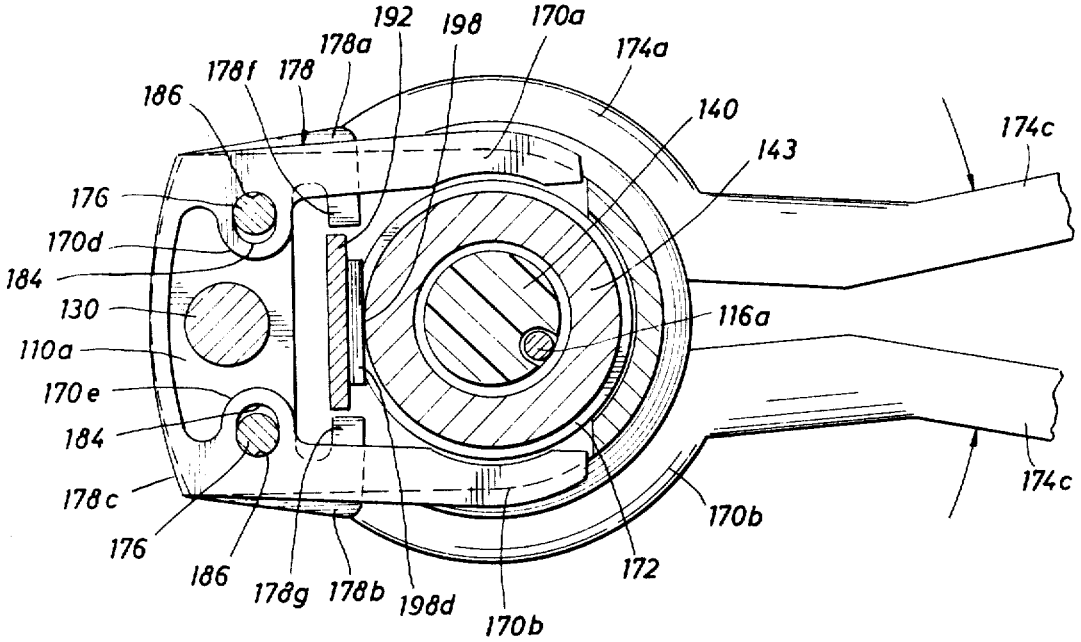
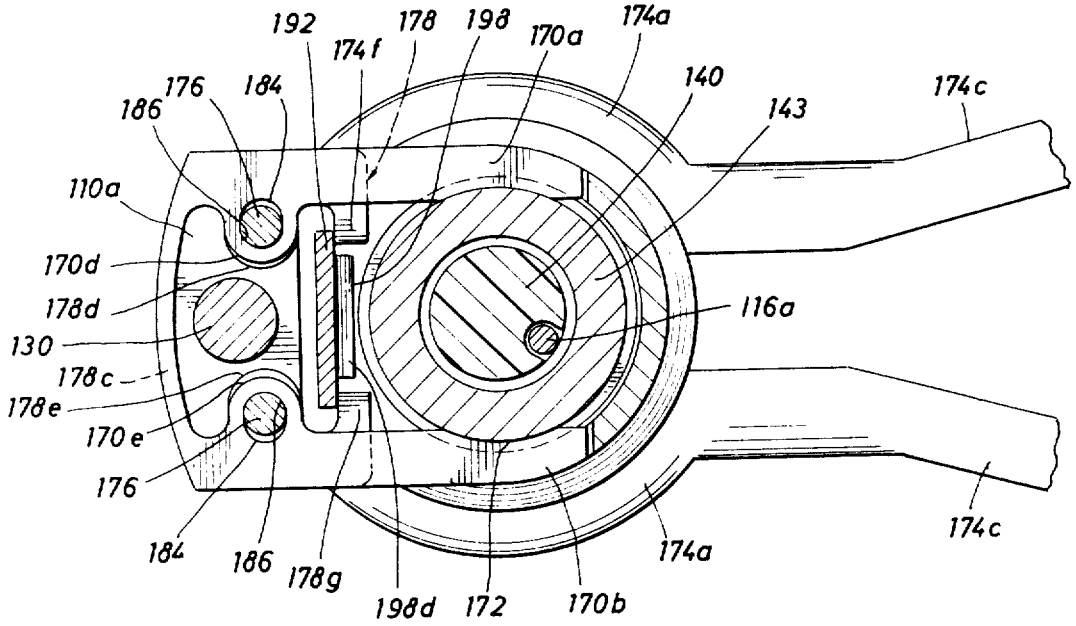
FIG. 26

CORK EXTRACTOR

BACKGROUND OF THE INVENTION

1. Field of the Invention

Various types of devices are known for extracting corks from bottles of wine and the like. Of these, the best known is probably the simple corkscrew, usually provided with an integral handle. The simple corkscrew is often preferred by professional waiters, wine stewards, and the like due to the fact that its small size makes it easily carried on the person. However, a relatively high degree of skill and expertise is required to keep a simple screw properly aligned and centered as it is being driven into a cork. Accordingly, the average consumer may have great difficulty in utilizing such a device without breaking the cork, and even professionals occasionally experience such difficulties. Furthermore, where a large number of bottles must be uncorked, as for a banquet, the simple screw, even in the hands of a professional, makes the process unduly time consuming.

Consequently, various more elaborate types of apparatus have been developed. Among the numerous objectives sought in the design of such devices are: speed of operation, means for reducing the force which must be exerted by the user to drive the screw into the cork and/or to pull the cork from the bottle; means for positively and accurately aligning the screw with respect to the cork; means for firmly gripping and/or supporting the bottle during the cork extracting process; and ensurance of removal of the cork without breakage.

2. Description of the Prior Art

One type of cork extracting apparatus which has been developed in response to the above needs is exemplified by U.S. Pat. No. 678,773, No. 644,088, No. 776,152 and No. 532,575. In this type of extractor, the corkscrew proper is rotatably mounted in a carrier, which in turn is mounted for longitudinal reciprocation with respect to a frame. As the carrier and corkscrew are moved downwardly by a suitable actuator such as a handle, the corkscrew is driven through a mating screw passage in a control nut. During this movement, the control nut is restrained against both longitudinal and rotational movements with respect to the frame, whereby rotational movement is imparted to the corkscrew upon downward movement through the screw passage. Thus the corkscrew may be driven into the cork in a bottle which is positioned below the control nut. Subsequently, the carrier and corkscrew are retracted upwardly by further movement of the actuator. At this time the control nut is still restrained against rotational movement with respect to the frame but is permitted to move longitudinally with the carrier and corkscrew. Thus, the corkscrew may be drawn upwardly without rotation to extract the engaged cork from the bottle.

Most such devices further provide for stripping the extracted cork from the screw. In particular, the actuator is used to again lower the carrier, corkscrew, and control nut, and when the latter reaches its original position, it is once again restrained against longitudinal movement with respect to the frame. Then, as the carrier is raised a second time, the corkscrew moving therewith will be rotated in a reverse direction by virtue of its passage through the screw passage of the fixed control nut, and will thereby be removed from the cork.

Although known apparatus of this general type partially achieves the objectives of a cork extractor for private or large volume professional use, it does not completely meet these needs, and additionally, produces further problems of its own. Many of these problems arise from the fact that, for one complete operation of the device, the carrier is reciprocated downwardly and back upwardly twice along the same path. However, during the first upward movement of the carrier, the control nut must be free to move upwardly with the corkscrew so that the cork can be extracted from the bottle, while during the second upward movement of the carrier, the nut must be fixed longitudinally with respect to the frame so that the corkscrew can be backed out of the cork.

Some of the prior art devices provide a camming mechanism or the like which automatically alternately latches and unlatches the control nut during successive upward movements of the carrier. However, such arrangements are unsatisfactory in that they are generally relatively complicated mechanically, which is not only undesirable in and of itself but further tends to increase the overall bulk and weight of the device. Furthermore, with such automatic mechanisms, movements of the actuator when the apparatus is not typically being employed to remove a cork can place the control nut latching mechanism in the wrong operational mode for beginning such a use.

In other devices, such as those disclosed in U.S. Pat. No. 678,773, No. 562,645 and No. 644,088, the latch for restraining the control nut against longitudinal movement is released by the portion of the apparatus which engages the bottle in such a way that it will be automatically released if the bottle is engaged. However, in each of these devices, the latch is operated by a weighted member and is therefore dependent on the force of gravity. Thus the latch can be inadvertently engaged or disengaged by improper positioning of the apparatus. Furthermore, in these devices it is relatively easy to release the latch, either directly or via the bottle-engaging means, even though a bottle is not actually being engaged, as by abutment of the weighted member by the user's hand or another foreign object.

In some such devices, such as those disclosed in U.S. Pat. No. 620,949, No. 845,608 and No. 676,205, the control nut is not only permitted to move upwardly with the corkscrew during the cork withdrawing portion of the operating cycle, but is positively latched to the corkscrew carrier or some other member moving therewith to ensure such joint movement. Thus, since the control nut, with the corkscrew engaged in its helical passage, moves upwardly with the carrier during the cork pulling stroke, it serves to prevent rotation of the corkscrew during that portion of the operating cycle and thus ensures that the corkscrew will remain engaged with the pull the cork from the bottle, rather than backing out of the cork by reverse rotation. However, as is the case with regard to the latching or unlatching of the control nut with respect to the frame in many prior art devices, the latching or unlatching of the control nut with respect to the carrier occurs automatically at the appropriate point in a complete operating cycle independently of whether or not a bottle and cork are actually engaged and the cork being pulled. Thus, it is possible in such prior art devices for the control nut to become latched to the carrier when a cork is not actually being pulled, thus placing the parts of the mechanism in the wrong operational mode for beginning an operating cycle.

Another problem generally presented by the type of cork extractor described above is that their mechanical arrangements render them so large and/or awkward that they can not be readily used in a hand-held mode. On the contrary, they must generally be affixed to a counter, table, or the like in order to be used conveniently and effectively. Still another problem presented by such prior art devices is that they do not afford a sufficient reduction in the force necessary to drive the corkscrew into the cork and/or to remove the cork from the bottle.

SUMMARY OF THE INVENTION

The present invention provides an improvement in a cork extractor of the type generally described above which includes latch means engageable and releasable independently of the force of gravity for releasably latching the control nut to the frame to restrain relative longitudinal movement therebetween. The apparatus further includes a bottle-engaging assembly connected to the frame for positioning a bottle with respect to the frame in longitudinal alignment with the screw passage of the control nut. This bottle-engaging assembly is associated with the aforementioned latch means and, when a bottle is engaged therein, is operative cooperatively with the engaged bottle to release the latch means.

In preferred embodiments of the invention, the bottle-engaging assembly includes clamp means for clasping and properly positioning the bottle. The clamp means include first and second grip elements relatively movable toward each other to cause the clamp means to clasp the bottle and away from each other to cause the clamp means to release the bottle. When a bottle is so clasped, the bottle-engaging assembly and the clasped bottle function cooperatively to release the latch means. For this reason, and because the latch means operates independently of the force of gravity, it is virtually impossible for the latch means to be released and the control nut displaced by accident. Rather, release of the latch means requires a positive and deliberate action on the part of the user, i.e. that of clasping a bottle neck or similar object with the clamp means. Since such an action could hardly be accomplished inadvertently, the latch release mechanism is virtually foolproof.

Likewise, preferred forms of the invention are provided with means for positively restricting rotation of the corkscrew as a cork is being pulled from a bottle to ensure that the cork is indeed pulled, rather than the cork crew backing out of the cork. In some forms of the invention, rotation of the corkscrew is prevented by means which interlock the control nut and the corkscrew when the aforementioned latch means is released and upon upward movement of the corkscrew relative to the frame. In these forms of the invention, such rotation restricting means are preferably operative only when the latch means is released. Since, as mentioned above, the latch means may be released only when a bottle or the like is being actively clasped with the clamp means, it is similarly impossible for the control nut to be interclocked with the corkscrew in the absence of such positive clasping action. In other embodiments, the means for restricting rotation of the corkscrew is dependent upon the screw being engaged in a cork and an upward force being exerted thereon.

Thus, in any of these preferred embodiments, it is virtually impossible for the corkscrew rotation restricting means to be operated inadvertently or at the wrong portion of a complete operating sequence. Nevertheless, when the apparatus is in the cork pulling portion of such a sequence, the rotation restricting means will automatically become operative. This feature is especially desirable in the most highly preferred forms of the invention wherein the corkscrew comprises a central metallic body and an outer layer or coating of friction-reducing material, such as polytetrafluoroethylene or other suitable plastic. Such a friction-reducing coating greatly decreases the force which must be exerted by the user in driving the corkscrew into the cork. However, because the friction between the corkscrew and the cork is reduced by such a coating, it is all the more desirable that the aforementioned rotation restriction means be provided in order to prevent the corkscrew from simply backing out of the cork when an upward force is exerted thereon.

Another feature which enhances the convenience of the apparatus is the fact that the guide means for guiding the carrier in its longitudinal path with respect to the frame is located laterally to one side of the corkscrew, rather than generally above the carrier. This substantially reduces the height of the apparatus. Furthermore, the guide means being located to one side of the corkscrew, may conveniently comprise a portion of the means for preventing relative rotation of the control nut and the frame.

Accordingly, it is a principal object of the present invention to provide an improved cork-extracting apparatus having foolproof latch release means for a control nut.

Another object of the present invention is to provide such an apparatus in which the means for releasing the latch comprises a bottle-engaging assembly operable cooperatively with an engaged bottle.

A further object of the present invention is to provide such an apparatus in which the latch means is engageable and releasable independently of the force of gravity.

Still another object of the present invention is to provide such a cork extractor having carrier guide means laterally spaced from the corkscrew.

Yet a further object of the present invention is to provide a cork extractor of the type generally described above including improved means for preventing the corkscrew from backing out of a cork in which it is engaged when pulled upwardly.

Still other objects, features and advantages of the present invention will be made apparent by the following detailed description of the preferred embodiments, the drawings and the claims.

BRIEF DESCRIPTION OF THE DRAWINGS

FIG. 3 is a front elevational view taken on the line 3—3 of FIG. 1.

FIG. 4 is a rear elevational view taken on line 4—4 of FIG. 1.

FIG. 5 is a top plan view taken on the line 5—5 of FIG. 1.

FIG. 12 is a cross-sectional view taken on the line 12—12 of FIG. 8 with the parts in unlatched condition.

FIG. 13 is a partial-sectional, partial-elevational view similar to FIG. 12 with the parts in latched condition.

FIG. 14 is a cross-sectional view taken on the line 14—14 of FIG. 8.

FIG. 15 is an enlarged cross-sectional view taken on line 15—15 of FIG. 2.

FIG. 17 is a partial-sectional, partial-elevational view similar to FIG. 6 showing a second embodiment of the invention at the beginning of a driving stroke.

FIG. 18 is a partial-sectional, partial-elevational view of the embodiment of FIG. 17 showing the apparatus at the end of the driving stroke, positioned for beginning the pulling stroke.

FIG. 19 is a detail view taken on line 19—19 of FIG. 17.

FIG. 20 is a view similar to FIG. 18 showing the apparatus at the end of the pulling stroke.

FIG. 21 is a view similar to FIG. 18 showing the apparatus at the end of the re-latching stroke.

FIG. 22 is a cross-sectional view taken on line 22—22 of FIG. 20.

FIG. 23 is an enlarged detail view taken on line 23—23 of FIG. 20.

FIG. 24 is a view similar to FIG. 26 with the parts in an intermediate position.

FIG. 25 is a view similar to FIG. 24 with the parts in unlatched condition and the catch engaged.

FIG. 26 is an enlarged detail view taken on line 26—26 of FIG. 21 with the parts in unlatched condition and the catch disengaged.

DESCRIPTION OF THE PREFERRED EMBODIMENTS

Figure 1:
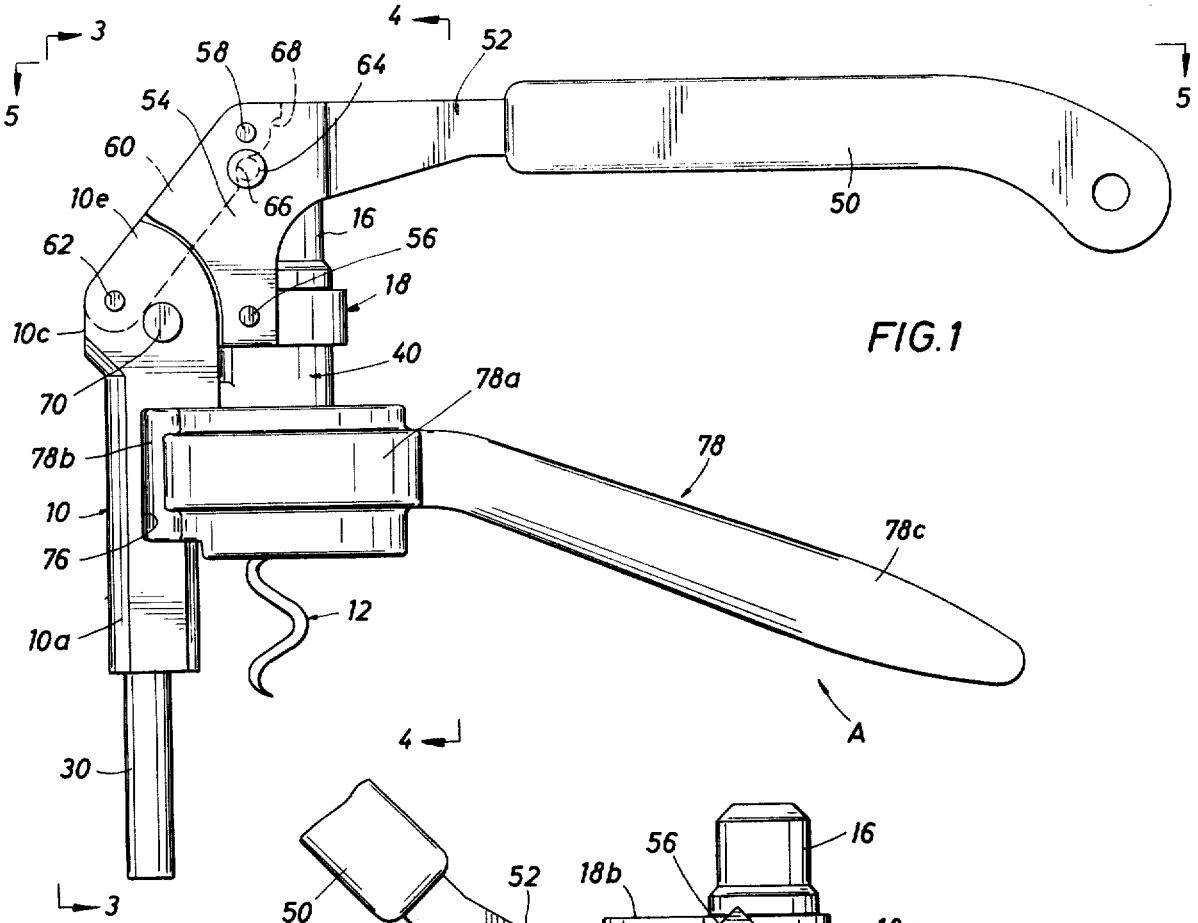
FIG. 1 is a side elevational view of a first embodiment of the invention.

Referring now to FIGS. 1—15, there is shown a first embodiment of cork-extractor comprising a frame 10 which generally serves as a base for mounting of the various other parts of the apparatus. In use, the apparatus is oriented generally as shown in FIG. 1, so that the frame 10 extends generally vertically. As used herein, terms such as "vertically," "horizontally," "upwardly," and "downwardly," will be construed with respect to the apparatus as it would appear when positioned for use on a bottle standing upright. Such terms are used merely for convenience, and are not intended in a limiting sense.

Figure 6:
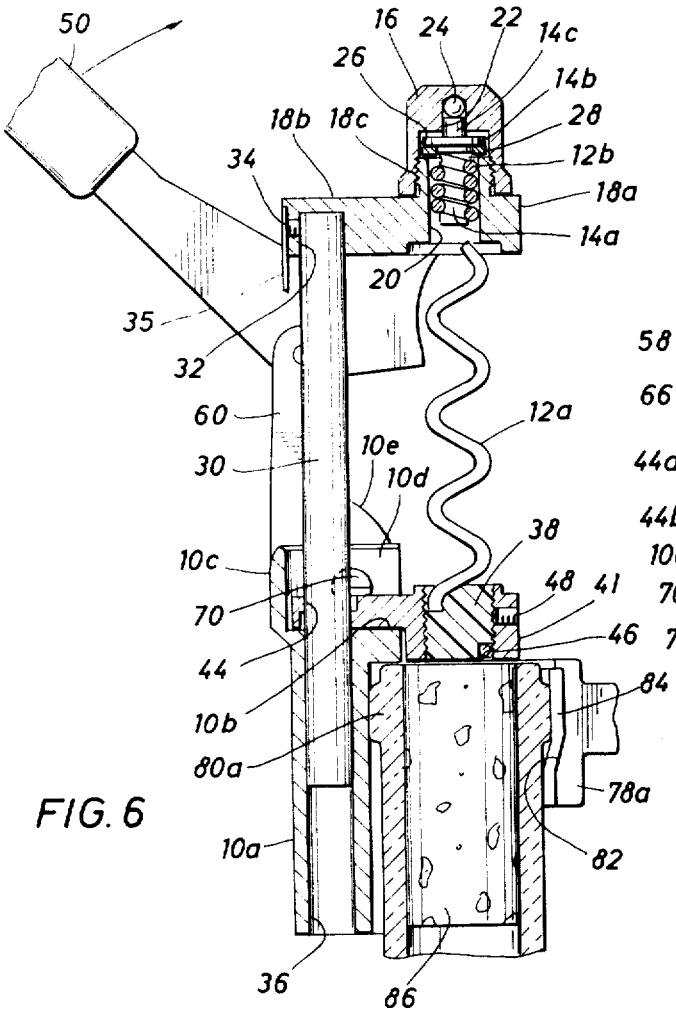
FIG. 6 is a cross-sectional view taken on line 6—6 of FIG. 3 but with the apparatus engaging a bottle and positioned for the beginning of the driving stroke of an operating sequence.
Figure 8:
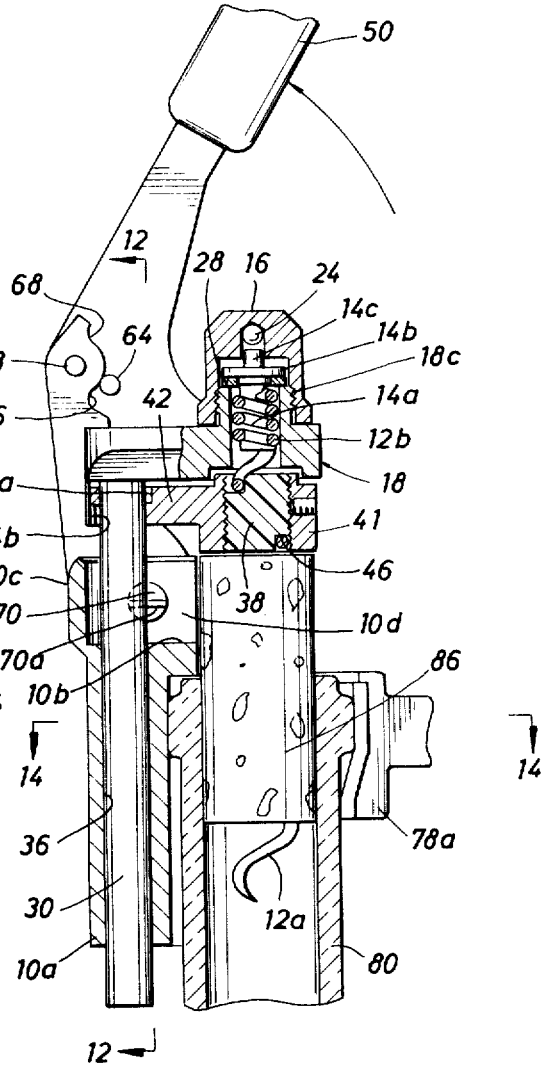
FIG. 8 is a cross-sectional view similar to FIG. 6 showing the apparatus during the pulling stroke.

The apparatus further comprises a corkscrew 12 which, as shown in FIGS. 6 and 8, includes a lower cork-engaging portion **12*a* and an upper connection portion 12*b*. Portion 12*a* forms a relatively large pitch helix, while portion 12*b* is wound into a much tighter or smaller pitch helix by which the corkscrew is attached to its bearing member 14. In particular, such bearing member includes a downwardly extending stud portion 14*a* having external threads formed thereon. The threads of stud portion 14*a* are sized and configured so that said stud portion can be threaded into the tightly wound connection portion 12*b* of the corkscrew. This method of mounting the corkscrew on its bearing member forms a clutch mechanism whereby, when the apparatus is fully assembled as described hereinbelow, attempted rotation of the lower corkscrew portion 12*a* in a direction which would tend to unthread upper portion 12*b* from stud portion 14*a* of the bearing member would simply cause connection portion 12*b* of the corkscrew to tighten about and more firmly grip stud portion 14*a*** thereby preventing such unthreading. Thus, accidental disconnection of the two members is virtually precluded.

Bearing member 14 for corkscrew 12 further comprises an annular flange **14*b* extending radially outwardly above stud portion 14*a* and a stub pin 14*c* extending upwardly above flange 14*b*. Corkscrew 12 is mounted, via its bearing member 14 in a carrier comprising upper and lower members 16 and 18, respectively. Lower bearing member 18 includes a main body portion 18*a* and a tongue 18*b* extending laterally therefrom. As used herein, terms such as "laterally," "radially," and "longitudinally" should be construed with reference to the axis of corkscrew 12 unless otherwise noted. The main body portion 18*a* of the lower carrier member has a longitudinal bore 20 therethrough for receipt of the connection portion 12*b* of the corkscrew and the engaged stud portion 14*a* of its bearing member. Bore 20 is partially defined by the inner diameter of a threaded nipple 18*c* which extends upwardly from main body portion 18*a***.

Upper carrier member 16 is generally cup shaped and is threaded onto nipple **18*c* as shown in FIGS. 6 and 8. Member 16 has a longitudinal recess 22 sized to receive stub pin 14*c* of corkscrew bearing member 14. A ball bearing 24 is received in the bottom of recess 22 for engagement with stub pin 14*c*. Member 16 is also counterboard at 26 to receive flange 14*b* of the bearing member. Counterbore 26 is also sized to expose the upper end surface of nipple 18*c*, said end surface in turn being sized to underlie flange 14*b* of the bearing member. A bearing washer 28 may be disposed between the upper end surface of nipple 18*c* and the lower surface of flange 14*b***.

It can thus be seen that the bearing member 14 and the corkscrew 12 are permitted free rotation with respect to carrier 16, 18. The upper end surface of nipple **18*c* and the shoulder defined between portions 22 and 26 of member 16 form opposed longitudinally facing stop surfaces cooperative with flange 14*b* to limit relative longitudinal movement between the corkscrew and its bearing member, on the one hand, and the carrier, on the other hand, and, in general, constrain them to move upwardly and downwardly in unison. However, the distance between the upper end surface of nipple 18*c* and the shoulder defined between portions 22 and 26 of member 16 is designed to permit some longitudinal play between bearing member 14*a*, 14*b*, 14*c* and carrier 16, 18**.

To guide carrier 16, 18 in a longitudinal path with respect to frame 10, there is provided a guide member in the form of a cylindrical rod 30. The upper end of rod 30 is rigidly fixed in a bore 32 in tongue **18*b* of the lower carrier member by a set screw 34. Rod 30 extends downwardly from carrier member 18 and is slidably received in a cylindrical bore 36 is frame 10. Thus rod 30 and bore 36 together serve as a guide means for carrier 16, 18. Comparing FIGS. 1, 3, 5, 6, and 12, it can be seen that frame 10 comprises a vertically elongate barrel 10***a*, in which bore 36 is formed and which terminates in an upwardly facing shoulder 10*b*. Frame 10 further includes a generally U-shaped rim extending upwardly from the upper end of barrel 10*a* and including a base section 10*c* and a pair of generally parallel legs 10*d* extending from respective ends of base section 10*c* toward the axis of corkscrew 12. Finally, frame 10 includes a pair of ears 10*e* each of which is spaced outwardly from and disposed generally parallel to a respective one of the legs 10*d*.

The apparatus further comprises a control nut comprising inner and outer members 38 and 40, respectively. Outer member 40 has a main body portion 41 and mounting flange 42 extending laterally therefrom. Flange 42 normally extends into the U-shaped rim formed by portions 10*c* and 10*d* of frame 10 and rests on the shoulder 10*b* defined by the upper surface of the frame barrel 10*a*. Flange 42 has a bore 44 therethrough aligned with bore 36 of frame barrel 10*a* for slidably receiving guide rod 30. For purposes to be described more fully below, bore 44 has a pair of partial annular relief areas 44*a* and 44*b* which provide respective reliefs or clearances adjacent rod 30. Relief 44*a* is formed on the side of bore 44 closest to the axis of corkscrew 12 and adjacent the upper extremity of the bore, while relief 44*b* is formed on the side of the bore distal the corkscrew axis and adjacent the lower extremity of the bore.

Inner control nut member 38 is mounted within main body 41 of outer control nut member 40 by fine threads. Member 38 may be further secured within member 40 by a set screw 48. The outer surface of inner member 38 also has a deeper thread 46 formed therein and sized and configured to mate with the cork engaging portion 12*a* of corkscrew 12. Thus, when inner member 38 is mounted within outer member 40, thread 46 forms a helical screw passage through the guide nut 38, 40, and when flange 42 of the control nut is received within the U-shaped rim 10*c*, 10*d* of frame 10, screw passage 46 is coaxially aligned with corkscrew 12 and receives cork-engaging portion 12*a* thereof.

With corkscrew 12 received in passage 46 of the control nut, the connection of flange 42 to guide rod 30 at a point laterally spaced from the centerline of the control nut prevents rotation thereof relative to frame 10. In the preferred embodiment shown, the length of corkscrew 12 is such that it will be at least partially engaged in screw passage 46 of the control nut, to thereby cooperate in preventing rotation of the latter, even when the corkscrew is in its uppermost position as shown in FIG. 6. To further stabilize the control nut 38, 40 against even slight pivotal movement about rod 30, at least in its lowermost position as shown in FIG. 6, legs 10*d* of the U-shaped rim of frame 10 are positioned to fit fairly closely adjacent the opposite sides of flange 42 (see FIG. 13).

It can also be seen that, since the corkscrew 12 is always at least partially received in screw passage 46, and since its carrier 16, 18 is rigidly affixed to rod 30, the latter in turn being mounted in frame 10 at a location laterally spaced from the corkscrew axis, rotation of carrier 16, 18 relative to frame 10 is prevented. Thus, because corkscrew 12 is rotatably mounted within carrier 16, 18 via bearing member 14, if the carrier 16, 18 is reciprocated longitudinally with respect to frame 10 while nut 38, 40 is held in a stationary position, rotation will be imparted to corkscrew 12 by virtue of its movement longitudinally within screw passage 46.

To effect such longitudinal reciprocation of the carrier, an actuator handle 50 is provided and connected to carrier 16, 18 and frame 10 by a linkage system. Handle 50 is generally elongate and has a pair of diverging tines 52 at one end thereof. Integrally formed with each tine 52 is a respective ear 54, the ears being parallel to each other and forming apart of the aforementioned linkage system, which is best seen by comparing FIGS. 1, 2, 3, and 5. The parallel ears 10*e* of frame 10 provide sites for connection of the linkage system to the frame 10.

As best seen in FIG. 1, ears 54 are generally perpendicular to handle 50. Handle 50 is pivotally connected to carrier 16, 18 via the ends of ears 54 distal tines 52 by pivot pins 56. Pivot pins 56 lie along a common axis extending through lower carrier member 18 perpendicular to the axis of corkscrew 12. Each of the ears 54 has a second pivot pin 58 located near the end of the ear adjoining the respective tine 52. Pivot pins 58 lie on a common axis parallel to pins 56, and each pivotally connects the respective ear 54 to one end of a respective one of two parallel links 60. The other end of each link 60 is pivotally connected by a respective pin 62 to a respective one of the ears 10*e*, pins 62 being on a common axis horizontally spaced from pins 56. The respective axes of the three sets of pins 56, 58, and 62 are parallel.

Figure 2:
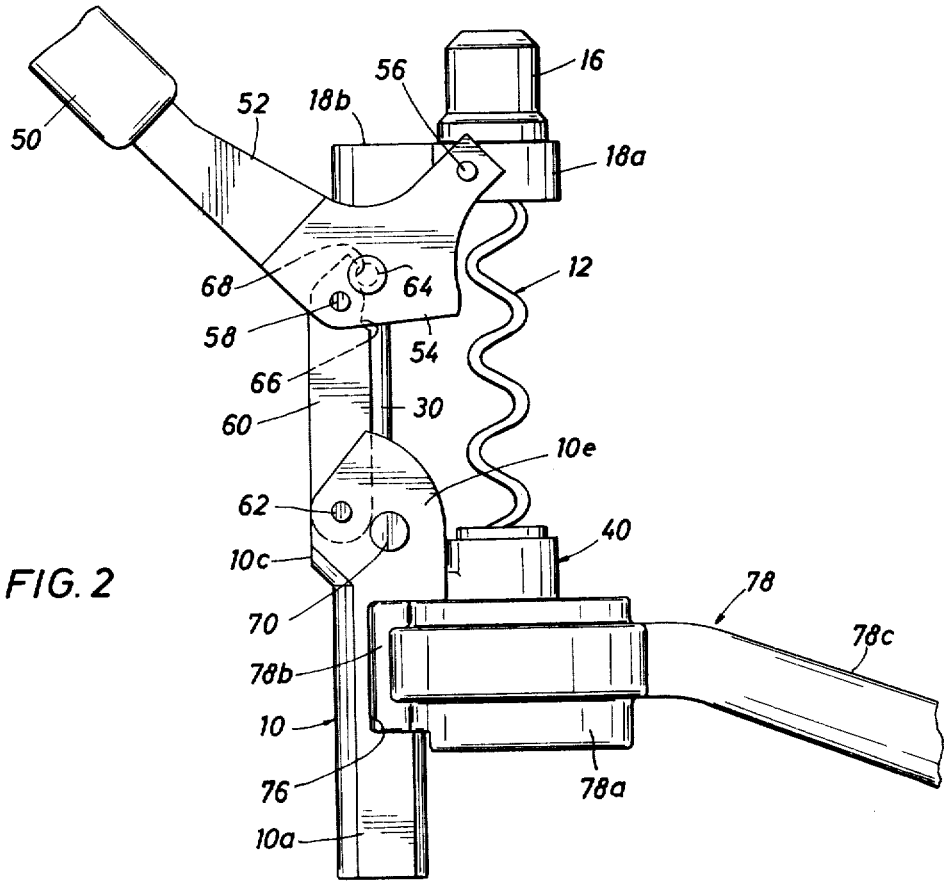
FIG. 2 is a partial side elevational view of the embodiment of FIG. 1 with the carrier raised to its uppermost position.

By comparing FIGS. 1 and 2, it can be seen that if handle 50 is pivoted about pins 56, longitudinal movement will be imparted to carrier 16, 18 via the linkage formed by ears 54 and links 60. Downward movement of carrier 16, 18 is limited by abutment thereof with control nut 38, 40. To limit upward movement of the carrier, a pair of stop pins 64 are mounted in respective ones of the ears 54 near pivot pins 58. Stop pins 64 extend inwardly toward each other across the edges of respective ones of links 60. Each link 60 has a first recess 66 in its peripheral edge positioned to receive the adjacent one of pins 64 to permit handle 50 to be moved to its lowermost position, as shown in FIG. 1. Each link 60 also has a second recess 68 in its peripheral edge disposed longitudinally outwardly of recess 66 and adapted to engage the respective pin 64, as shown in FIG. 2, to limit upward movement of carrier 16, 18. The recess 66 and 68 of each link 60 are connected by a convex surface over which the respective pin 64 slides as the carrier is reciprocated between its uppermost and lowermost positions.

As previously mentioned, control nut 38, 40 must remain stationary in order to impart rotary motion to corkscrew 12 as the latter is longitudinally reciprocated. For this purpose, latch means are provided for releasably latching the control nut to the frame to restrain relative longitudinal movement therebetween. As best shown in FIG. 6, 12, and 13, the latch means comprise a pair of latch elements 70. Each of the latch elements 70 has a cylindrical shank slidably mounted in a respective one of the ears 10*e* and the adjacent rim leg 10*d* of frame 10. At the inner end of such cylindrical shank, each of the latch elements 70 further comprises a projection defining a downwardly facing shoulder 70*a* and a cam surface 70*b* inclined upwardly and outwardly from the free edge of the shoulder 70*a* to the upper extremity of the latch element 70. Shoulders 70*a* are positioned to overlie the mounting flange 42 of outer control nut member 40 when flange 42 is resting on the upper surface 10*b* of frame barrel 10*a* as shown in FIG. 13. Thus latches 70 may serve to retain flanges 42 against surface 10*b* thereby preventing relative longitudinal movement of the control nut 38, 40 with respect to frame 10. This position, shown for example in FIGS. 6 and 13, will be referred to as the "latched condition" of the latch elements 70 and control nut 38, 40.

The latch elements 70 are resiliently biased toward each other, and thus toward mounting flange 42 and into their latched or engaged position, by a pair of spring rods 72. Frame barrel 10*a* has a pair of longitudinal bores 74 there-through for receipt of respective ones of the spring rods 72. Each bore 74 is interrupted by a cut-away section 76 in the frame barrel 10*a* (see FIGS. 1, 12, 13, and 14). Each rod 72 has a threaded pin 76 rigidly affixed to its lower end and threaded into the lower end of the respective bore 74 to anchor the rod therein. However, the remainder of the spring rod 72, i.e. the portion which actually serves as the spring, has a loose fit within the bore 74, the latter being oversized with respect to the spring portion of the rod to permit lateral play thereof. The upper end of each spring rod 72 is rigidly affixed to a respective one of the latches 70, and the spring rods 72 are positioned relative to bores 74 and pins 76 so as to bias said latches toward each other as mentioned hereinabove. However, the latch elements 70 may be urged away from each other against the bias of the spring rods 72 to release flange 42 of control nut 38, 40 for longitudinal movement of the latter with respect to frame 10.

The mechanism for so releasing the latch elements 70 is incorporated in a bottle-engaging assembly which further serves to position a bottle with respect to frame 10 in general longitudinal alignment with screw passage 46. This bottle-engaging assembly comprises a pair of clamp members generally indicated by the numeral 78. Each of the clamp members includes a respective clasp portion 78*a*. As best shown in FIG. 14, clasp portions 78*a* are opposable and generally arcuate in transverse cross-section whereby, when moved toward each other, they may serve to clasp the bottle neck 80.

Each clamp member 78 further comprises a respective attachment portion 78*b* integral with the respective clasp portion 78*a*. Each of the attachment portions 78*b* is located at one end of the arc of the respective clasp portion 78*a*. Each attachment portion 78*b* is received in a respective one of the cut-away portions 76 of frame barrel 10*a* and is pivotally mounted on a respective one of the spring rods 72. Thus, as best seen in FIG. 14, spring rods 72 provide pivot axes for the clamp members 78 located generally to one side of the locus of bottle neck 80, which in turn is generally aligned with the axis of corkscrew 12 when clasped by clasp portions 78*a*.

Finally, each clamp member 78 includes a respective grip portion or grip element 78*c* rigidly extending from the respective clasp portion 78*a* generally on the opposite side thereof from the respective attachment portion 78*b*. Grip portions 78*c* may be conveniently grasped by the user to move the clamp members, and specifically the clasp portions 78*a* thereof, toward each other to clasp a bottle or away from each other to release the bottle by pivoting the clamp members about rods 72.

As shown, for example, in FIG. 6, clasp portions 78*a*, when viewed in longitudinal section, include downwardly and inwardly inclined support sections 82 adapted to underlie the drip ring 80*a* of bottle 80 when clasped by the clamp members 78. This not only permits firmer gripping of the bottle neck, but even permits the bottle to be supported by the bottle-engaging assembly if desired. Furthermore, the inner or opposed surfaces of clasp portions 78*a* are padded by liners 84 of a suitable elastomer to protect the bottle neck.

Referring again to FIGS. 12, 13, and 14, the interrelationship between the latch elements 70 and the bottle-engaging assembly can be seen. As previously mentioned, the portions of rods 72 above pins 76, i.e. the upper portions which actually serve as the spring elements, are loosely fitted within bores 74 of frame barrel 10*a* for lateral play therein. The threaded portions of bores 74 which receive studs 76 have their centerlines offset from those of the upper portions of bores 74 so that, when studs 76 are threaded into the lower portions of bores 74, the spring portions of rods 72 will be disposed toward the laterally inner extremities of bores 74 as shown in FIG. 13. In this way, the spring portions of rods 72 are caused to bias the connected latch elements 70 inwardly toward each other, also as shown in FIG. 13. However, while the bores 74 are oversized with respect to the spring portions of rods 72, the attachment portions 78*b* of the clamp members have a relatively close pivoting fit on rods 72.

When a bottle is emplaced between the clasp portions 78*a* of clamp members 78, and grip portions 78*c* are squeezed toward each other, the bottle neck 80 serves as a fulcrum about which clamp members 78 may pivot. This pivoting moves the attachment portions 78*b*, along with the engaged rods 72 away from each other generally tangentially or circumferentially of the bottle, as indicated by the arrows in FIG. 14. Such movement in turn urges latch elements 70 away from each other to the unlatched position shown in FIG. 12 whereby shoulders 70*a* no longer overlie the flange 42 of the control nut and the latter is permitted to move upwardly with respect to frame 12.

The operation of the cork extractor is best illustrated in FIGS. 6–11. In particular, to remove a cork 86 from a bottle, actuator handle 50 is pivoted away from grip portions 78*c* of the clamp members to place carrier 16, 18 in its uppermost position as shown in FIG. 6. It will be noted that, in such position, the lower end of corkscrew 12 is engaged in screw passage 46 but does not protrude therefrom. The upper end of the bottle neck 80 is then emplaced beneath control nut 38,40 and clasped with the clamp members 78 by squeezing grip portions 78*c* thereof toward each other. This not only properly positions and/or supports the bottle neck with respect to the apparatus, but also serves to release latch elements 70 by urging them to their unlatched position as explained hereinabove.

Figure 7:
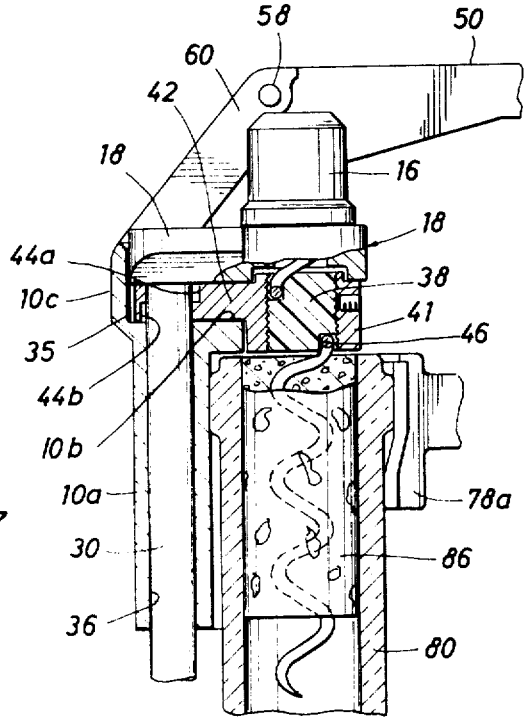
FIG. 7 is a partial-sectional, partial-elevational view similar to FIG. 6 showing the apparatus at the end of the driving stroke, positioned for beginning the pulling stroke.

Actuator handle 50 is next pivoted back toward grip portions 78*c* in what may be termed the "driving stroke" of the operating sequence to move carrier 16, 18 to its lowermost position as shown in FIG. 7. Even though the latch elements 70 are, during the driving stroke, in their unlatched position due to the gripping of bottle neck 80 by clamp members 78, the only longitudinal force exerted on control nut 38, 40 during the driving stroke is a downward force, and control nut 38, 40 can not move downwardly with respect to frame 10 from the position in FIG. 6 due to the abutment of its flange 42 with surface 10*b* of frame 10. Thus, during the driving stroke, the cork-engaging portion 12*a* of corkscrew 12 is forced longitudinally through screw passage 46 and caused to rotate thereby driving it into cork 86.

Figure 9:
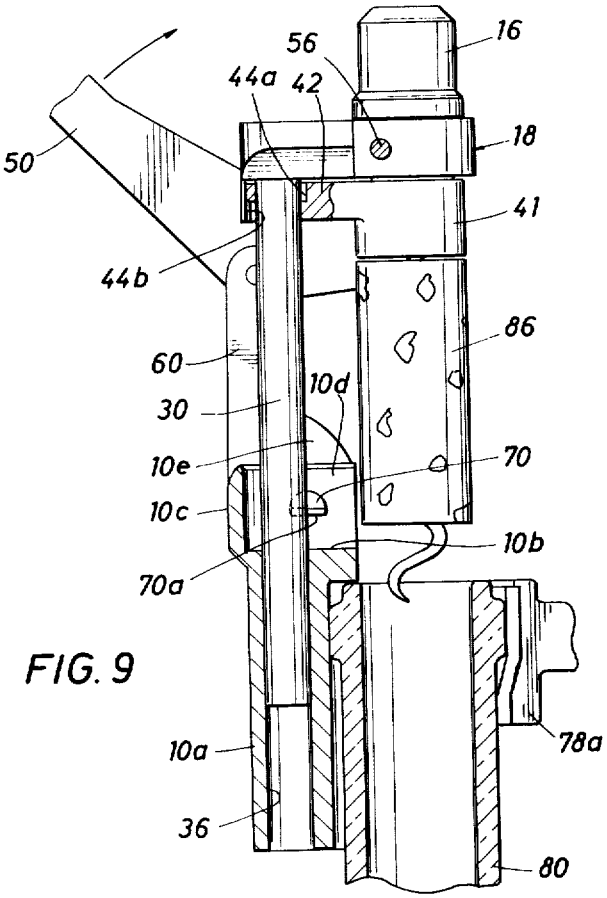
FIG. 9 is a partial-sectional, partial-elevational view similar to FIG. 6 showing the apparatus at the end of the pulling stroke, positioned for beginning the re-latching stroke.
Figure 11:
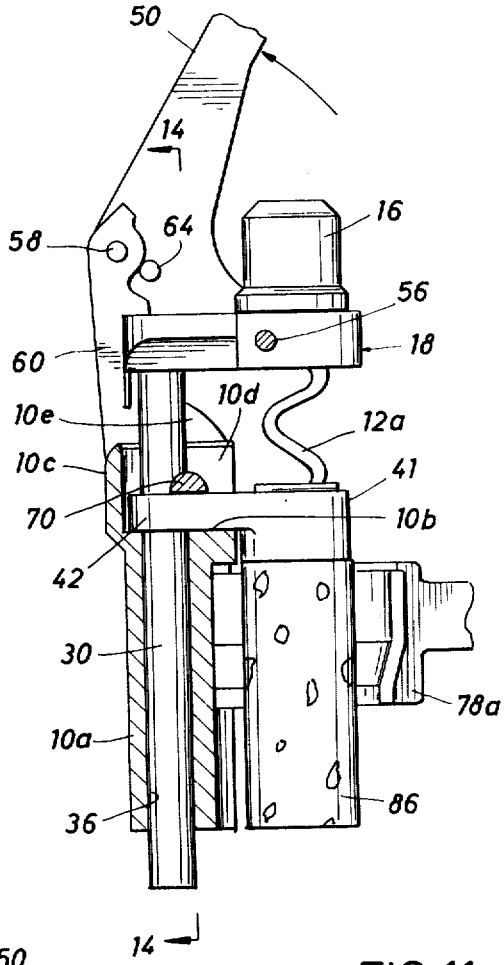
FIG. 11 is a view similar to FIG. 9 showing the apparatus during the stripping stroke.

From the position shown in FIG. 7, handle 50 is pivoted back away from grip portions 78*c* in the "pulling stroke" of the operating sequence, while still clasping bottle neck 80 with clamp members 78. FIG. 8 shows the apparatus during the pulling stroke. The grasping of bottle neck 80 with clamp members 78 retains latch elements 70 in their unlatched positions so that, during the pulling stroke, control nut 38, 40 is free to move upwardly along with the engaged corkscrew 12 and its carrier 16, 18 so that, rather than being forced to rotate and back out of the cork 86 and screw passage 46, the cork-engaging portion 12*a* of the corkscrew may remain engaged with and pull cork 86 from bottle neck 80. FIG. 9 shows the apparatus at the end of the pulling stroke with cork 86 completely removed from bottle neck 80.

Although the extracted cork 86 could be manually removed from corkscrew 12, the apparatus itself may be used to strip the cork from the corkscrew. To accomplish this, bottle neck 80 is released from clamp members 78. Although the grip portions 78*c* may still be grasped and squeezed toward each other by the user with one hand to support the apparatus, without bottle neck 80 to serve as a fulcrum, such gripping will merely cause the clamp members 78 to pivot freely about rods 72, rather than urge the rods away from each other against their resilient bias. Thus, once bottle neck 80 has been released, latch elements 70 will automatically return to their inner or latching positions.

Figure 10:
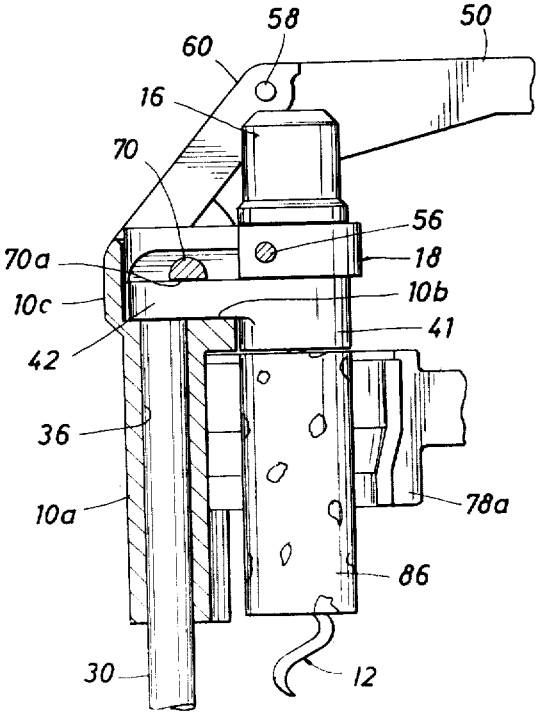
FIG. 10 is a view similar to FIG. 9 showing the apparatus as the end of the re-latching stroke.

Handle 50 is then once again pivoted toward grip portions 78*c* of the clamp members in what may be called a "relatching stroke" of the operating sequence. During this stroke, carrier 16,18, corkscrew 12, cork 86, and nut 38, 40 move downwardly in unison. As the flange 42 of the control nut begins to enter the space defined by the U-shaped rim 10*c*, 10*d* of the frame 10, its lower edge will engage inclined cam surfaces 70*b* of latch elements 70 thereby camming the latch elements outwardly away from each other against the resilient bias of rods 72 to permit flange 42 to pass beneath the latch elements. At that point, rods 72 will urge latch elements 70 back inwardly to their latched position in which shoulders 70*a* thereof overlie flange 42 and nut 38, 40 is once again restrained against longitudinal movement relative to frame 10. FIG. 10 shows the apparatus at the end of the re-latching stroke.

Finally, handle 50 is again pivoted away from grip portions 78*c* to raise the carrier 16, 18 and corkscrew 12 in a "stripping stroke." Since the control nut 38, 40 is now restrained against upward movement, raising of carrier 16, 18 will pull cork-engaging portion 12*a* of corkscrew 12 through the screw passage 46 thereby causing it to rotate and back out of the cork 86 and nut 38, 40. It should be observed that, after cork 86 is thus stripped from the corkscrew 12, the parts of the apparatus will then be in the position shown in FIG. 6, i.e. ready to begin another sequence of operation.

An important feature of the apparatus described above is that the latch means 70 not only operate independently of the force of gravity, as opposed to some prior art latches, but in addition, are so associated with the clamp members 78 that the latch elements 70 can not be released, i.e. moved to their unlatched position, unless the clamp members 78 are being used to actively grip a bottle neck or other similar object. Mere gripping of portions 78*c* without such an object interposed between clasp portions 78*a* to serve as a fulcrum will not release the latch elements 70. Furthermore, when a bottle neck or the like has been clasped to release the latch elements 70, and the control nut 38, 40 has been raised above the locus of the latch elements, the first downstroke after release of the bottle neck will automatically return the control nut to its lowermost position, and the latch elements 70 will snap into overlying relation to flange 42 so that these parts are again properly positioned for the beginning of an operating sequence. In other words, once the control nut has been latched in place on the frame by the latch elements 70, it is virtually impossible for it to be accidently misplaced by ordinary handling of the apparatus during periods of non-use, and it always remains in the appropriate position for beginning a sequence of operation, it then merely being necessary to raise handle 50 to place the entire apparatus in proper position for beginning of a pulling stroke.

As explained above, release of latch elements 70 by clasping of a bottle neck or the like frees the control nut 38, 40 for potential longitudinal movement, and more specifically upward movement, with respect to frame 10. However, in some instances—depending on such factors as the relative frictional forces between various parts of the apparatus, the bottle and the cork, it is possible that the control nut, although free to move upwardly with the carrier and corkscrew, may not so move. If this should occur on the pulling stroke of a sequence of operation, the cork would not in fact be removed from the bottle neck, but on the contrary, the corkscrew would move through the passage 46 in the control nut, rotating in a reverse direction and simply backing out of the cork into which it had been previously driven.

The possibility of this occuring in the absence of preventative measures as described hereinbelow, is increased in the preferred forms of the invention in which the cork-engaging portion 12*a* of the corkscrew is specially treated so that its outer surface has an especially low coefficient of friction. This is done to decrease the force which must be exerted in driving the cork-engaging portion of the corkscrew into a cork. The preferred way of so treating the cork-engaging portion of the corkscrew is illustrated in FIG. 15 wherein it is shown that the cork-engaging portion 12*a* of corkscrew 12 comprises a central body 90 of a suitable metal coated with an outer layer 92 of friction-reducing material such as a polytetrafluoroethylene or other suitable plastic. It has been found that such plastic coatings drammatically reduce the force which must be exerted in driving a corkscrew into a cork. At the same time however, such coatings also reduce the frictional forces between the corkscrew and cork during the pulling stroke thereby enhancing the possibility of the "backing out" phenomenon described above.

Accordingly, the apparatus of the invention includes means for restricting rotation of the corkscrew during the pulling stroke of an operating sequence such as that described above. As explained above, if the corkscrew is moved longitudinally through the screw passage 46, while the control nut 38, 40 is held stationary, rotation will be imparted to the corkscrew. Conversely, if the control nut 38, 40 is caused to move with the carrier 16, 18 or some connected part, it will actively prevent rotation of the engaged corkscrew portion 12*a*. Thus, one means for restricting rotation of the corkscrew is by providing for interlocking of the control nut and the corkscrew when the latch means is released and upon upward movement of the corkscrew relative to the frame. This is done by providing for frictional binding of the control nut flange 42 and the guide rod 30 when the latch means are released and an upward force is exerted on the corkscrew.

As previously mentioned, the bore 44 through flange 42 which receives rod 30 has relieved areas 44*a* and 44*b*, the remainder of bore 44 being sized for a fairly close sliding fit with rod 30. It can be seen that if the main body 41 of outer control nut member 40 were cooked or tilted downwardly with respect to rod 30, the close fitting portions of bore 44 (i.e. the portions appearing at the upper left and lower right of the bore as viewed in FIGS. 6–8) would bind against rod 30 thereby preventing downward movement of the nut 38, 40 thereon and/or upward movement of rod 30 through bore 44. Such movement, i.e. downward movement of the nut with respect to the rod and/or upward movement of the rod with respect to the nut, will be referred to herein as relative movement of those two members in a "first directional mode." As previously mentioned, movement in the first directional mode becomes impossible due to frictional binding of the rod 30 in the close fitting portions of bore 44 if the main body 41 of nut member 40 is cocked or tilted downwardly even slightly. However, due to the relieved areas 44*a* and 44*b*, movement in a second directional mode opposite to the first mode, i.e. upward movement of nut 38, 40 and/or downward movement of rod 30, will be permitted and frictional handling of rod 30 in bore 44 will not occur even if the main portion of nut 38, 40 is cocked or tilted slightly upwardly with respect to rod 30.

Accordingly, again referring to FIG. 6, it can be seen that during the driving stroke of a sequence of operations a downward force will be exerted on rod 30, i.e. a force tending to cause relative movement of rod 30 and control nut 38, 40 in the second directional mode. Due to the engagement of control nut 38, 40 with the cork-engaging portion 12*a* of corkscrew 12, and to the longitudinal play permitted the corkscrew and its bearing 14 with respect to carrier 16, 18, the main portion of control nut 38, 40 will tend to resist downward movement and thus will tend to cock or tilt slightly upwardly with respect to rod 30 during such movement. However, as explained above, rod 30 will be permitted to move downwardly through bore 44 due to relieved areas 44*a* and 44*b*. However, during the pulling stroke illustrated in FIG. 8, attempted movement of rod 30 is in the first directional mode, i.e. upwardly with respect to control nut 38, 40. Again due to the engagement of corkscrew portion 12*a* with the control nut and to the longitudinal play of the corkscrew and its bearing member 14 in the carrier 16, 18, the main portion of control nut 38, 40 will tend to resist upward movement and, because the latch elements 70 will have been released by clasping of bottle neck 80, will be permitted to cock or tilt downwardly with respect to rod 30. This in turn will cause frictional binding of the close fitting portions of bore 44 on rod 30 thereby preventing relative movement of the rod and control nut in the first directional mode and forcing the control nut to move upwardly in unison with rod 30 and the connected carrier and corkscrew. Thus, during the pulling stroke the control nut will prevent rotation of corkscrew 12 and ensure extraction of cork 86.

During the relatching stroke initiated from the position shown in FIG. 9, attempted movement of rod 30 will again be in the second directional mode. However, since control nut 38, 40 will be in its upper position in abutment with lower carrier member 18, it will be forced to move downwardly with rod 30 and carrier 16, 18 even though relieved areas 44*a* and 44*b* of bore 44 would otherwise permit relative movement of the rod and control nut in that mode. Finally, rod 30 and the attached carrier and corkscrew will again be raised to strip the cork 86 from the corkscrew as explained hereinabove. However, during this stroke relative movement of the rod and control nut in the first directional mode will be permitted since the flange 42 is firmly latched between surface 10*b* of frame 10 and shoulders 70*a* of the latch elements 70 thereby preventing cocking or tilting of the control nut with respect to rod 30 and therefore preventing frictional binding of the rod on the close fitting portions of bore 44.

It can thus be seen that the configuration of bore 44 ensures that, upon an upward stroke of rod 30, control nut 38, 40 will also move upwardly thereby preventing rotation of corkscrew 12 if but only if latch elements 70 are released or in their unlatched position.

Another feature which further ensures that the control nut 38, 40 will move upwardly with rod 38 and carrier 16,18 when latch members 70 are released is a leaf spring 35 affixed to the outer side of tongue 18*d* of lower carrier member 18 distal corkscrew 12. Spring 35 depends downwardly from tongue 18*d* and is biased laterally inwardly toward rod 30. When carrier 16,18 is moved downwardly, e.g. as shown in FIG. 7, spring 35 engages and is forced outwardly by flange 42 of control nut 38,40. Thus, upon a subsequent upward stroke, spring 35 enhances the aforementioned tendency of the configuration of bore 44 to cause firm frictional engagement between the surfaces of that bore and rod 30.

Other techniques for preventing the corkscrew from backing out of an engaged cork may be used either alternatively with or together with one or more of the features described above. For example, the desired frictional binding between the bore 44 of the mounting flange of the control nut and guide rod 30 may be achieved without the provision of recessed areas such as 44*a* and 44*b* by a slightly offsetting of the axis of corkscrew 12 from the centerline of the arcuate clasp portions 78*a* of the clamp members, which in turn locates the centerline of bottle neck 80 abnd cork 86 with respect to the apparatus.

Another alternative method of directly resisting rotation of corkscrew 12 during a pulling stroke of the apparatus is by providing the aforementioned friction-reducing coating or layer only on the downwardly facing surfaces of cork-engaging portion 12*a* of the corkscrew, leaving the central metallic body 90 of the corkscrew exposed along the upwardly facing surfaces of cork-engaging portion 12*a*. Since the downwardly facing surfaces of corkscrew portion 12*a* engage the cork during the driving stroke, while the upwardly facing surfaces actively bear against the cork during the pulling stroke, the coefficient of friction between the cork and the actively-engaged surfaces of the corkscrew will then be greater during the pulling stroke. This can be accomplished either by initially coating only the downwardly facing surfaces of the cork-engaging portion of the corkscrew with the friction-reducing material, or alternatively, by first coating the entire cork-engaging portion of the corkscrew with such material and then grinding the friction-reducing material off of the upwardly facing surfaces thereof.

Still another method of preventing the corkscrew from backing out of the cork during the pulling stroke is by applying the aforementioned friction-reducing material only to the lower end of the cork-engaging portion of the corkscrew, e.g. about the lowermost centimeter or half inch. Since resistance to driving of the corkscrew through the cork is greatest at the beginning of the driving stroke, such coating of the lowermost end of the cork-engaging portion of the corkscrew is sufficient to lessen the force needed to begin the driving stroke. At the end of the driving stroke, the coated end of the cork-engaging portion of the corkscrew will have been driven completely through the cork. Then during the pulling stroke, only uncoated surfaces of the corkscrew will be engaged with the cork so that the friction therebetween will be sufficient to resist backing out of the corkscrew.

The apparatus described above effects several other note-worthy advantages. Specifically, by placing the guide means 30, 36 laterally to the side of corkscrew 12, the need for a raceway on the frame extending upwardly from the lowermost position of the carrier, as in prior art devices, is eliminated. Thus, the vertical profile of the device is considerably reduced. Furthermore, this positioning of the guide means makes it possible to use such guide means as a portion of the mechanism for restraining the control nut and carrier against rotation.

By virtue of its positioning, the guide means also serves, with grip portions **78*c* of the clamp members, to prevent the sharp end of corkscrew 12 from striking a table or the like. Referring to FIG. 2, it can be seen that, when the corkscrew 12 is in its uppermost position, its lower end does not project below the clamp members 78, but rather is disposed within the control nut. As the corkscrew is lowered, the guide rod 30 moves with it. The lower end of rod 30 always being disposed lower than the lower end of corkscrew 12. Also, as shown in FIG. 14, the ends of attachment portions 87*b* of the clamp members are generally lobed. The recesses 76 in frame 10 which receive attachment portions 78*b* are generally squared. Thus, abutment of surfaces 78*d* of attachment portions 78*b* with the flattened end surfaces 76*a* of recesses 76 prevents grip portions 78*c* from moving away from each other beyond the location indicated in phantom at 78*c*'. Accordingly, grip portions 78*c* will always extend laterally away from the path of corkscrew 12 on the opposite side thereof from guide means 30,36. Then, by proper choice of the length of guide rod 30, the device can be designed so that the lower end of corkscrew 12 will always be located above a transverse plane through the ends of the grip portions 78*c* of the clamp members and the lower extremity of the guide means 30,36. For example, FIG. 1 shows that, even in its lowermost position, corkscrew 12** is located above such plane, indicated at A.

Referring now to FIGS. 17–26, there is shown a second embodiment of the invention. The cork extractor of the second embodiment includes a frame 110 including a substantially vertical portion **110*a* and a portion 110*b* projecting laterally therefrom. The apparatus further comprises a corkscrew 116 which, like corkscrew 12 of the first embodiment, includes a lower cork-engaging portion 116*a* forming a relatively large pitch helix and an upper connection portion 116*b* forming a tight pitch helix threaded onto the stud portion 118*a* of the corkscrew's bearing member 118. Bearing member 118 further includes a radially extending flange 118*b* and an upwardy extending stub pin 118*c***.

Corkscrew 116 is mounted, via bearing member 118, in a carrier comprising upper and lower members 120 and 122, respectively. Lower carrier member 122 has a bore 124 therethrough which loosely receives stud portion **118*a* of bearing member 118 and the surrounding connection portion 116*b* of corkscrew 116. Flange portion 118*b* of bearing member 118 overlies the upper surface of lower carrier member 122 in the area surrounding bore 124. Upper carrier member 120 is undercut at 126 to accommodate flange portion 118*b*, and is further recessed at 128 to receive stub pin 118*c***.

A guide rod 130 has a relatively large diameter lower portion and a relatively small diameter upper end defining an upwardly facing shoulder **130*a* between the large and small diameter portions. The smaller diameter upper end of guide rod 130 extends through a vertical bore 132 in lower carrier member 122 and is threaded into an aligned socket 134 in upper carrier member 120. Thus, guide rod 130 serves to connect upper and lower carrier members 120 and 122. Guide rod 130 is laterally spaced from the axis of corkscrew 116. Bearing member 118 and corkscrew 116 are permitted free rotation with respect to carrier 120,122, and undercut 126 and recess 128 are further sized to permit some limited longitudinal play between bearing member 118 and carrier 120,122. To guide carrier 120,122 in a longitudinal path with respect to frame 110, guide rod 130 is telescopically mounted in a cylindrical bore 136 through the vertical portion 110*a* of frame 110 whereby rod 130 and bore 136 together serve as a guide means for carrier 120,122**.

Laterally projecting portion **110*b* of frame 112 has an opening 138 therethrough for receipt of the main body of a control nut comprising inner and outer members 140 and 142, respectively. Outer member 142 of the control nut has a main body 143 and a flange 144 extending laterally therefrom into a notch 146 in vertical portion 110*a* of frame 110. Flange 144 has an aperture 148 therethrough slidably receiving guide rod 130. Like the control nut of the first embodiment, control nut 140,142 defines a helical screw passage therethrough receiving cork-engaging portion 116*a* of corkscrew 116**.

With control nut 140,142 mounted in opening 138 and/or engaged with cork-engaging portion **116*a* of corkscrew 116, the connection of its flange 144 to guide rod 130 at a point laterally spaced from the axis of corkscrew 116 prevents rotation of the control nut relative to frame 10. Likewise, with cork-engaging portion 116*a* of corkscrew 116 engaged in control nut 140,142, guide rod 130 and bore 136 prevent rotation of carrier 120,122 relative to frame 110. Thus, if carrier 120, 122 is reciprocated longitudinally with respect to frame 110, rotation will be imparted to corkscrew 116** by virtue of its movement longitudinally within the screw passage of the control nut.

To effect such longitudinal reciprocation, an actuator handle 152 is provided and connected to carrier 120,122 and frame 110 by a linkage system. Since this linkage system is substantially identical to that of the first embodiment, its structure and operation will not be described in detail. Briefly, handle 52 has a pair of diverging tines 154 at one end thereof with parallel ears 156 integrally formed with respective ones of tines 154. A pair of parallel ears, one of which is shown at 158, integral with frame 110 extend generally upwardly therefrom to provide sites for connection of the linkage system to the frame. Ears 156 are pivoted to lower carrier member 122 at 160 on an axis perpendicular to that of corkscrew 116 and also at 162 to a pair of parallel links, one of which is shown at 164, the links 164 in turn being pivoted to frame ears 158 at 166. When the handle 152 is operated to raise carrier 120,122, via the linkage system, to the position shown in FIG. 17, diverging tines 154 will abut parallel links 164 thereby preventing further upward movement. Downward movement of the carrier is, of course, limited by abutment thereof with frame portion **110*b* and/or control nut 140, 142**.

Frame 110 has a slot 168 extending laterally through vertical portion **110*a* and into laterally projecting portion 110*b* communicating with the nut-receiving opening 138 thereof. A latch 170 is received in slot 68. As best seen in FIGS. 24–26, latch 170 is a generally U-shaped member formed of spring metal, specifically, latch 170 includes a pair of generally parallel legs 170*a* and 170*b* having adjacent ends joined by a thin spring section 170*c* forming the base of the U and biasing legs 170*a* and 170*b* toward each other. Latch 170 is positioned in slot 168 with section 170*c* in vertical portion 110*a* of frame 110 and legs 170*a* and 170*b* extending into laterally extending frame portion 110*b* generally tangentially to nut 140,142. Main body 143 to outer member 142 of the control nut has an annular groove 172 extending radially thereinto. When the control nut 140,142 is in its lowermost position as shown in FIG. 18, groove 172 is aligned with and receives the innermost portions of legs 170*a* and 170*b* of the latch (compare FIG. 26). Thus, latch 170 normally latches the control nut 140,142 to the frame 110 to restrain relative longitudinal movement therebetween. However, as indicated in FIG. 25, legs 170*a* and 170*b* may be urged away from each other to release the latch and permit relative longitudinal movement between nut 140, 142 and frame 110**.

As in the case of the first embodiment of cork-extractor, the mechanism for so releasing the latch 170 is incorporated into a bottle-engaging assembly including clamp members 174 substantially identical to clamp members 78 of the first embodiment. More specifically, clamp members 174 include respective arcuate clasp portions **174*a* each having an attachment portion 174*b* integral with one end thereof and a grip portion 174*c*** integral with the other end thereof.

Clamp members 174 are mounted on pivot pins 176, which in turn are mounted in portion **110*a* of frame 110 so as to extend vertically through respective ones of the cut away sections 110*c* of the frame which receive attachment portions 174*b* of the clamp members. As best shown in FIGS. 17 and 24–26, an override spring 178, to be described more fully below, is mounted in a recess in frame 112 immediately below latch 170. Briefly, override spring 178 is generally U-shaped having generally parallel legs 178*a* and 178*b* underlying but shorter than respective legs 170*a* and 170*b* of latch 170. The ends of legs 178*a* and 178*b* located within vertical porton 110*a* of frame 110 are interconnected by a spring metal base 178*c*, underlying and substantially identical to base 170*c* of latch 170, and serving to bias legs 170*a* and 178*b*** laterally inwardly toward each other.

Each of the pivot pins 176 extends through a set of generally aligned bores in frame portion **110*a*, latch 170, and override spring 178. More specifically, each pin 176 extends into a pair of oversized bores 180 and 182 in frame portion 110*a* located respectively above and below the respective cut away portion 110*a*. Latch legs 170*a* and 170*b* have respective lobes 170*d* and 170*e* formed thereon extending laterally inwardly toward each other and defining respective bores 184 generally aligned with a respective pair of the bores 180 and 182 and receiving a respective one of the pivot pins 176. As best seen by comparing FIGS. 23 and 24, bores 184 are oversized with respect to pins 176, but not as large as bores 180 and 182 in frame portion 110*a***.

Legs **178*a* and 178*b* of override spring 178 also include respective lobes 178*d* and 178*e* underlying lobes 170*d* and 170*e* respectively defining bores 186 generally aligned with bores 184 and snuggly receiving respective pivot pins 176**.

Attachment portions **174*b* of clamp members 174 have vertical bores 188 (see FIG. 17) also snuggly receiving respective pivot pins 176. When a bottle is emplaced between the clasp portions 174*a* of clamp members 174, and grip portions 174*c* are squeezed toward each other, the bottleneck 190 serves as a fulcrum about which clamp members 74 may pivot. This pivoting moves the attachment portions 174*b*, along with their pivot pins 176, away from each other generally tangentially or circumferentially of the bottle as in the preceeding embodiment of the invention. Such movement of pins 176 is permitted by the oversizing of the bores 180 and 182 in frame portion 112. As such movement begins, legs 178*a* and 178*b* of override spring 178, being mounted on pins 176 by snug fitting bores 186, will move laterally away from each other against the biasing force of base 178*c*. Pins 176 will subsequently come into abutment with the laterally outermost portions of bores 184 whereupon further movement of pins 176 away from each other circumferentially of the bottle will also cause latch legs 170*a* and 170*b*** to move laterally away from each other.

FIG. 26 shows both latch 170 and override spring 178 in their normal positions in which their respective legs **170*a*, 170*b* and 178*a*, 178*b* are in their laterally innermost positions, legs 170*a* and 170*b* of latch 170 being engaged in groove 172 of control nut 140,142. FIG. 24 shows the apparatus as grip portions 174*c* are first squeezed together so that pivot pins 176 have moved apart far enough to begin urging legs 178*a* and 178*b* of override spring 178 away from each other, the pins having been thus moved to the laterally outer extremities of bores 184 so that they are ready to begin moving latch legs 170*a* and 170*a* and 170*b* away from each other. FIG. 25 shows the apparatus after further movement of pins 176 away from each other whereby latch legs 170*a* and 170*b* have been moved laterally away from each other and out of groove 172 so that nut 140,142 is free to move upwardly with respect to frame 110**.

As in the preceeding embodiment, interlock means are also provided to ensure that, when the latch legs **170*a* and 170*b* have been disengaged from groove 172 as shown in FIG. 25, and the carrier 120,122 has been moved to its lowermost position via handle 152, control nut 140,142 will indeed move upwardly upon subsequent upward movement of the carrier, thereby preventing corkscrew 116 from rotating and backing out of the cork. The interlock means includes a catch element 192 mounted in lower carrier member 122 in any suitable manner and extending through and downwardly from member 122 as shown in FIGS. 17, 18, 20, and 21. Catch element 192 is positioned on carrier member 122 generally between bores 124 and 132 and so that, when carrier member 122 is lowered, catch element 192 may pass through an opening 194 through the flange portion 144 of the control nut adjacent the intersection of such flange portion and the main body 143 of outer nut member 142. Catch element 192 is formed of spring metal and is biased toward the main body of outer control nut member 142. However, carrier member 22 is undercut as indicated at 196 to permit catch element 192 to be forced away from the main body of control nut member 142 and outwardly along its flange 144** in a manner to be described more fully below.

Catch element 192 has a tooth 198 integrally formed at its lower end on the side adjacent the main body of the control nut member 142. As best shown in FIG. 19, tooth 198 has a relatively wide lower portion **198*a* and a narrower upper portion 198*b*. Furthermore, the outer surface 198*c* of tooth 198 which faces generally toward the main body of the control nut member 142 is inclined upwardly and inwardly from its lower extremity and terminates in an upwardly facing shoulder 198*d*. The length of catch element 192 is such that, when carrier member 122 is lowered to its lowermost position, shoulder 198*d* will be positioned to underlie the upper surface of groove 172 in main body 143 of control nut member 142. However, unless the clamp members 174 are being used to actively a grip a bottle neck or other such member, override spring 178 will urge catch element 192 outwardly away from main body 143 so that shoulder 198*d* is spaced outwardly from groove 172**.

More specifically, the legs **178*a* and 178*b* of override spring 178 distal base 178*c* have respective tabs 178*f* and 178*g* extending laterally inwardly toward each other. Accordingly, when legs 178*a* and 178*b* are in their innermost positions, the tabs 178*f* and 178*g* can engage the wider portions of catch element 192 and tooth 198 to urge catch element 192 away from groove 172 as shown in FIGS. 21 and 26. However, when a bottle is gripped by clamp members 174, and legs 178*a* and 178*b* are moved away from each other as shown in FIG. 25, even the widest portions of catch element 192 and its integral tooth 198 can pass between tabs 178*f* and 178*g* so that the upper edge of tooth 198 can pass into groove 172 in the control nut, shoulder 198*d* underlying the downwardly facing upper surface of such groove. Then, if the carrier member 122, to which catch element 192, is attached is moved upwardly, the interengagement of tooth 198 and groove 172 will force control nut 140,142** to move upwardly with the carrier.

A typical sequence of operation of the device is as follows. As shown in FIG. 17, handle 152 is operated to raise carrier 120,122, along with corkscrew 116 and its bearing member 118, to their uppermost positions. The apparatus is emplaced on the neck 190 of a bottle, the latter being clasped with the clasp portions **174*a* of the clamp members 174 by squeezing together the grip portions 174*c* thereof. As explained hereinabove, this operates first to move legs 178*a* and 178*b* of override spring 178*a* apart as shown in FIG. 24 and subsequently to move latch legs 170*a* and 170*b* apart and out of groove 172 as shown in FIG. 25. Carrier 120,122 is then lowered via handle 152 in a driving stroke to the position shown in FIG. 18. During this stroke, control nut 140,142 imparts rotary motion to corkscrew 116 and drives it into the cork 200 in bottle neck 190. Also, since tabs 178*f* and 178*g* are urged away from each other by the aforementioned gripping of bottle neck 190 by clamp members 174, the upper edge of tooth 198 of catch element 192 will move into groove 172 during the driving stroke. More particularly, as the catch element 192 moves downwardly, the upper edge of the main body of control nut member 142 at opening 194 will engage the inclined surface 198*c* defined by tooth 198 and temporarily urge catch element 192 outwardly away from the control nut to permit the upper edge of tooth 98 to move into alignment with groove 172. The upper edge of tooth 198 then snaps into groove 172 with shoulder 198*d* underlying the upper surface of such groove as shown in FIGS. 18 and 25**.

Next, while continuing to squeeze grip portions **174*c* of clamp members 174 to retain latch 170 in its released position as shown in FIG. 25, carrier 120,122 is returned to its upper position by operation of handle 152 in a pulling stroke. Because latch legs 170*a* and 170*b* are released from groove 172, nut 140,142 is free to move upwardly with carrier 120,122, and the engagement of shoulder 198*d* of tooth 198 of the catch element 192 with the upper surface of groove 172 ensures such upward movement. This in turn ensures that rotation of corkscrew 116 is prevented and that cork 200 is pulled from the bottle neck as shown in FIG. 20. Bottle neck 190 is next released from clamp members 174. This permits tabs 178*f* and 178*g* of the override spring 178 and latch legs 170*a* and 170*b* of latch 170 to return to their innermost positions as shown in FIG. 23. Then, in the relatching stroke, carrier 120,122 is again lowered forcing nut 140,142 downwardly with it. As main body 143 begins to move into alignment with latch 170, the lowermost portion 143*a* of its side surface, being downwardly and inwardly tapered as shown in FIGS. 20 and 21, engages the laterally inner edges of latch legs 170*a* and 170*b* to temporarily cam them outwardly to permit the necessary downward movement of the control nut. When the control nut reaches its lowermost position, latch legs 170*a* and 170*b* will be aligned with and will snap into groove 172** thereby retaining the control nut in its lowermost position until if and when again released by gripping a bottle neck.

Simultaneously, catch element 192 moves through opening 194 in the control nut. However, since tabs **178*f* and 178*g* of the override member have returned to their innermost positions, they will engage the wider portions of catch element 192 and its tooth 198 forcing them outwardly away from groove 172 as shown in FIGS. 21 and 26. Thus, tooth 198 is not permitted to interfere with subsequent upward movement of the attached carrier 120,122 in the stripping stroke. During such stroke, since the control nut is held in its lowermost position by latch 170, upward movement of carrier 120,122 along with corkscrew 116 will impart rotary motion to the latter via its passage through the helical passage in the control nut thereby causing it to be withdrawn from the cork 200**. The apparatus is then in position to begin the next sequence of operation.

Figure 16:
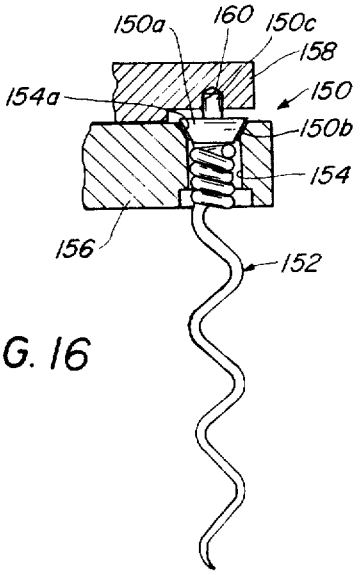
FIG. 16 is a detail sectional view showing a modified carrier and screw bearing.

FIG. 16 shows an alternative expedient for resisting the "backing out" phenomenon by increased contact area between the corkscrew bearing member and the carrier during upward strokes. The bearing member 150 for corkscrew 152 has a flange **150*a* having a frusto-conical underside 150*b*. The upper end of the bore 154 in lower carrier member 156 has a matching frusto-conical section 154*a*. Due to the vertical play permitted member 150 with respect to carrier 156,158, surfaces 150*b* and 154*a* are engaged during upward strokes, providing a relatively large contact area. During downward strokes, the upper end of stub pin 150*c* of the bearing member engages the bottom of a mating recess 160 in upper carrier member 158**, thereby presenting a small contact area and low frictional resistance to rotation. A similar result can be obtained by using a bearing member flange whose underside is planar, rather than frusto-conical, but wide enough to provide the desired area for contact with the upper surface of the lower carrier member on upward strokes.

Numerous modifications of the preferred embodiments described above may be made without departing from the spirit of the invention. For example, various features of the different embodiments may be interchanged or combined.

Other modifications will suggest themselves to those of skill in the art. Accordingly, it is intended that the scope of the present invention be limited only by the claims which follow.

I claim:

1. Apparatus for extracting a cork from a bottle comprising:

a frame;

a carrier mounted on said frame for longitudinal reciprocating movement with respect to said frame;

guide means cooperative between said frame and said carrier for guiding said carrier in a longitudinal path with respect to said frame;

a corkscrew rotatably mounted on said carrier for joint longitudinal movement therewith, the axis of rotation of said corkscrew being generally coincident with the centerline of said corkscrew and extending generally longitudinally with respect to said carrier;

a control nut having a screw passage therethrough, said screw passage being positioned to receive said corkscrew and configured to mate with the configuration of said corkscrew whereby, upon longitudinal movement of said corkscrew in said screw passage, rotational movement will be imparted to said corkscrew;

actuator means operatively connected to said carrier for selectively longitudinally reciprocating said carrier in said longitudinal path;

means cooperative between said control nut and said frame for preventing relative rotation therebetween;

latch means engageable and releasable independently of the force of gravity for releasably latching said control nut to said frame to restrain relative longitudinal movement therebetween;

and bottle-engaging means connected to said frame for positioning a bottle with respect to said frame in longitudinal alignment with said screw passage, said bottle-engaging means being associated with said latch means and, when a bottle is engaged by said bottle-engaging means, operative cooperatively with the engaged bottle to release said latch means.

2. Apparatus according to claim 1 wherein said latch means is resiliently biased into latching engagement with said control nut, and wherein said bottle-engaging means is operative cooperatively with the engaged bottle to urge said latch means away from said control nut against said resilient bias.

3. Apparatus according to claim 2 wherein said latch means includes a pair of latch elements disposed generally on opposite sides of said control nut and resiliently biased toward each other, and said bottle-engaging means being operative cooperatively with the engaged bottle to urge said latch elements away from each other.

4. Apparatus according to claim 3 wherein said bottle-engaging means comprises a pair of clamp members having:

respective opposable clasp portions relatively movable toward each other, to clasp the neck of a bottle and position the bottle with respect to said frame in longitudinal alignment with said screw passage, and away from each other, to release the bottle;

respective attachment portions rigidly adjoining respective ones of said clasp portions and having pivot means mounted on said frame generally to one side of the center of the locus of a bottle clasped by said clasp portions to permit said relative movement of said clasp portions toward and away from each other;

and respective grip portions each rigidly extending from a respective one of said clasp portions generally on the opposite side of said clasp portion from the respective attachment portion, said grip portions being movable toward and away from each other for so moving said clasp portions.

5. Apparatus according to claim 4 wherein each of said attachment portions is connected to a respective one of said latch elements, and said pivot means are adapted to permit relative movement of said attachment portions toward and away from each other generally circumferentially of a bottle, whereby when said grip portions are urged toward each other to cause said clasp portions to clasp a bottle, said clamp members pivot about the bottle to move said attachment portions circumferentially away from each other and thereby urge said latch elements away from each other.

6. Apparatus according to claim 5 wherein said clasp portions have opposed padded arcuate bottle-engaging surfaces.

7. Apparatus according to claim 6 wherein said bottle-engaging surfaces of said clasp portions have downwardly and inwardly inclined support sections for underlying the drip ring of a bottle.

8. Apparatus according to claim 3 comprising inclined cam surfaces cooperative between said control nut and said latch elements for urging said latch elements away from each other as said control nut is moved downwardly into alignment with said latch elements for latching engagement therewith.

9. Apparatus according to claim 5 wherein said control nut has a mounting flange extending generally laterally away from said screw passage, said frame having a generally upwardly directed stop surface engageable with the underside of said mounting flange, and said latch elements being reciprocably mounted in said frame and positioned to overlie said mounting flange when the latter is engaged with said stop surface.

10. Apparatus according to claim 9 comprising a pair of spring elements extending generally longitudinally of said apparatus for so biasing said latch elements toward each other, each of said spring elements being relatively tightly connected to a respective one of said latch elements and to a respective one of said attachment portions of said clamp members and relatively loosely received in said frame to permit lateral play of said spring elements with respect to said frame.

11. Apparatus according to claim 10 wherein said spring elements also serve as said pivot means of said attachment portions of said clamp members.

12. Apparatus according to claim 5 wherein said latch elements comprise a pair of latch legs disposed generally tangentially with respect to said control nut, said control nut having latch groove means extending radially thereinto for receipt of said latch legs, and wherein said latch means further includes a spring element connecting adjacent ends of said latch legs to bias said latch legs toward each other and form therewith a generally U-shaped latch member.

13. Apparatus according to claim 1 wherein said guide means is laterally spaced from said corkscrew.

14. Apparatus according to claim 13 wherein said guide means includes an elongate movable guide member connected to said carrier and longitudinally slidably mounted in said frame.

15. Apparatus according to claim 14 wherein said control nut has a mounting flange extending laterally therefrom and connected to said movable guide member for relative longitudinal sliding movment therebetween.

16. Apparatus according to claim 14 wherein said bottle-engaging means includes grip means extending generally laterally outwardly from the centerline of said corkscrew and wherein said movable guide member extends downwardly below the lower end of said corkscrew by a distance such that the lower end of said corkscrew is always spaced from a transverse plane interconnecting the lower extremity of said guide means and the outer extremity of said grip means.

17. Apparatus according to claim 1 wherein said bottle-engaging means includes clamp means for clasping the neck of a bottle and positioning the bottle with respect to said frame in longitudinal alignment with said screw passage, said clamp means including first and second grip elements relatively movable toward each other to cause said clamp means to clasp the bottle and away from each other to cause said clamp means to release the bottle, said bottle-engaging assembly being operative, when a bottle is clasped by said bottle-engaging means, cooperatively with the engaged bottle to release said latch means.

18. Apparatus according to claim 1 wherein said actuator means includes a handle pivotally connected to said carrier for movement about an axis generally transverse to the axis of said corkscrew, said actuator means further comprising linkage means interconnecting said handle and said frame for converting such pivotal movement of said handle to longitudinal movement of said carrier.

19. Apparatus according to claim 1 further including means operative, when said latch means is released, for restricting relative rotation between said corkscrew and said control nut upon upward movement of said corkscrew whereby said corkscrew and said control nut may move upwardly in unison.

20. Apparatus according to claim 19 wherein said means for restricting rotation of said corkscrew is operative only when said latch means is released.

21. Apparatus according to claim 20 wherein said means for restricting rotation of said corkscrew comprises means for interlocking said control nut and said corkscrew when said latch means is released and upon upward movement of said corkscrew relative to said frame.

22. Apparatus according to claim 21 wherein said guide means is laterally spaced from said corkscrew and includes an elongate movable guide member connected to said carrier and longitudinally slidably mounted in said frame, and wherein said control nut has a mounting flange extending laterally therefrom and connected to said movable guide member for relative longitudinal sliding movement therebetween, said means for restricting rotation of said corkscrew comprising means for causing frictional binding of said mounting flange and said guide member, when said latch means is released, upon attempted upward movement of said control nut relative to said guide member.

23. The apparatus of claim 22 wherein said mounting flange has a bore therethrough slidably receiving said guide member, said bore having a pair of partial annular relief areas, one in the portion of said bore closest to said screw passage and adjacent the upper extremity of the bore, and the other in the portion of said bore farthest from said screw passage and adjacent the lower extremity of the bore.

24. Apparatus according to claim 23 wherein the non-relieved portion of said bore provides a relatively close sliding fit with said guide member, and wherein said latch means is operative, when engaged, to maintain said bore in substantial coaxial alignment with the centerline of said guide member.

25. Apparatus according to claim 21 further comprising a catch element carried by said carrier member, said catch element and said control nut having interengageable catch surfaces permitting said control nut to be supported on said catch element, said catch element being resiliently biased toward said control nut for engagement of said catch surfaces, and said apparatus further comprising override means operatively associated with said latch means for urging said catch surfaces out of engagement with each other when said latch means is engaged.

26. Apparatus according to claim 19 wherein said carrier comprises opposed first and second axially facing bearing surfaces, wherein said apparatus further comprises a bearing member affixed to said corkscrew and having first and second oppositely axially facing bearing surfaces, said first and second bearing surfaces of said carrier being spaced apart by a distance greater than the distance between said first and second bearing surfaces of said bearing member, and said bearing member being mounted for longitudinal play between said first and second bearing surfaces of said carrier, whereby said first bearing surfaces may be loaded and said second bearing surfaces unloaded for urging said corkscrew downwardly, and said second bearing surfaces may be loaded and said first bearing surfaces unloaded for urging said corkscrew upwardly, said first bearing surface of said bearing member being substantially smaller than said second bearing surface of said bearing member.

27. Apparatus according to claim 19 wherein said corkscrew comprises a central metallic body and an outer layer of friction-reducing material coating at least a portion of the downwardly facing surfaces of said body.

28. Apparatus for extracting a cork from a bottle comprising:

a frame;

a carrier mounted on said frame for longitudinal reciprocating movement with respect to said frame;

a corkscrew rotatably mounted on said carrier for joint longitudinal movement therewith, the axis of rotation of said corkscrew being generally coincident with the centerline of said corkscrew and extending generally longitudinally with respect to said carrier;

guide means laterally spaced from said corkscrew and cooperative between said frame and said carrier for guiding said carrier in a longitudinal path with respect to said frame and including an elongate movable guide member connected to said carrier and longitudinally slidably mounted in said frame, a control nut having a screw passage therethrough, said screw passage being positioned to receive said corkscrew and configured to mate with the configuration of said corkscrew whereby, upon longitudinal movement of said corkscrew in said screw passage, rotational movement will be imparted to said corkscrew, and including a mounting flange extending laterally therefrom and connected to said movable guide member for relative longitudinal sliding movement therebetween;

actuator means operatively connected to said carrier for selectively longitudinally reciprocating said carrier in said longitudinal path;

means cooperative between said control nut and said frame for preventing relative rotation therebetween;

latch means engageable and releasable for releasably latching said control nut to said frame to restrain relative longitudinal movement therebetween;

bottle-engaging means connected to said frame for positioning a bottle with respect to said frame in longitudnal alignment with said screw passage;

and means for causing frictional binding of said mounting flange and said guide member, when said latch means is released, upon attempted upward movement of said control nut relative to said guide member.

29. The apparatus of claim 28 wherein said mounting flange has a bore therethrough slidably receiving said guide member, said bore having a pair of partial annular relief areas, one in the portion of said bore closest to said screw passage and adjacent the upper extremity of the bore, and the other in the portion of said bore farthest from said screw passage and adjacent the lower extremity of the bore.

30. Apparatus according to claim 29 wherein the non-relieved portion of said bore provides a relatively close sliding fit with said guide member, and wherein said latch means is operative, when engaged, to maintain said bore in substantial coaxial alignment with the centerline of said guide member.

31. Apparatus for extracting a cork from a bottle comprising:

a frame;

a carrier mounted on said frame for longitudinal reciprocating movement with respect to said frame;

guide means cooperative between said frame and said carrier for guiding said carrier in a longitudinal path with respect to said frame;

a corkscrew rotatably mounted on said carrier for joint longitudinal movement therewith, the axis of rotation of said corkscrew being generally coincident with the centerline of said corkscrew and extending generally longitudinally with respect to said carrier;

a control nut having a screw passage therethrough, said screw passage being positioned to receive said corkscrew and configured to mate with the configuration of said corkscrew whereby, upon longitudinal movement of said corkscrew in said screw passage, rotational movement will be imparted to said corkscrew;

actuator means operatively connected to said carrier for selectively longitudinally reciprocating said carrier in said longitudinal path;

means cooperative between said control nut and said frame for preventing relative rotation therebetween;

latch means engageable and releasable for releasably latching said control nut to said frame to restrain relative longitudinal movement therebetween;

bottle-engaging means connected to said frame for positioning a bottle with respect to said frame in longitudinal alignment with said screw passage;

and a catch element carried by said carrier member, said catch element and said control nut having interengageable catch surfaces permitting said control nut to be supported on said catch element, said catch element being resiliently biased toward said control nut for engagement of said catch surfaces, and said apparatus further comprising override means operatively associated with said latch means for urging said catch surfaces out of engagement with each other when said latch means is engaged.

* * * * *